US010750845B2

(12) United States Patent
Castro

(10) Patent No.: US 10,750,845 B2
(45) **Date of Patent: *Aug. 25, 2020**

(54) WEARABLE WAFER TURN CLIP AND RELATED APPARATUS, SYSTEMS, AND METHODS

(71) Applicant: Jessir, LLC, Glendale, AZ (US)

(72) Inventor: Christopher Mickal Castro, Glendale, AZ (US)

(73) Assignee: Jessir, LLC, Glendale, AZ (US)

( * ) Notice: Subject to any disclaimer, the term of this patent is extended or adjusted under 35 U.S.C. 154(b) by 12 days.

This patent is subject to a terminal disclaimer.

(21) Appl. No.: 15/859,038

(22) Filed: Dec. 29, 2017

(65) Prior Publication Data

US 2018/0116385 A1 May 3, 2018

Related U.S. Application Data

(63) Continuation of application No. 14/697,442, filed on Apr. 27, 2015, now Pat. No. 9,867,454.

(60) Provisional application No. 62/117,258, filed on Feb. 17, 2015.

(51) Int. Cl.
*A45F 5/02* (2006.01)

(52) U.S. Cl.
CPC ..... *A45F 5/02* (2013.01); *A45F 5/021* (2013.01); *A45F 2200/0508* (2013.01); *A45F 2200/0516* (2013.01); *A45F 2200/0525* (2013.01); *A45F 2200/0558* (2013.01); *A45F 2200/0575* (2013.01)

(58) Field of Classification Search
CPC .... A45F 5/02; A45F 5/021; A45F 2200/0575; A45F 2200/0558; A45F 2200/0525; A45F 2200/0508; A45F 2200/0516; Y10T 24/13; Y10T 24/1391; Y10T 24/1394
See application file for complete search history.

(56) References Cited

U.S. PATENT DOCUMENTS

| | | | | |
|---|---|---|---|---|
| 1,814,978 | A | 7/1931 | Swanson | |
| 4,069,999 | A | 1/1978 | Rew | |
| 6,685,067 | B2 | 2/2004 | French | |
| 7,299,527 | B1 | 11/2007 | Gyure | |
| 8,936,222 | B1 | 1/2015 | Bastian et al. | |
| 2002/0153395 | A1* | 10/2002 | Martinez | B26B 29/025 224/232 |
| 2003/0085244 | A1 | 5/2003 | Parsons | |

(Continued)

*Primary Examiner* — Robert Sandy
*Assistant Examiner* — Rowland Do
(74) *Attorney, Agent, or Firm* — Foley & Lardner LLP

(57) ABSTRACT

A wearable wafer turn clip may selectably connect a device and/or device mount to an article, such as an operator's clothing. The wearable wafer turn clip may include a body ring forming a partial annulus, a grip ring forming a flange extending outwardly of the body ring, and an inner section extending inwardly from the body ring into a center area of the annulus of the body ring. The wearable wafer turn clip may have a mounting portion that is a channel between the body ring and at least a portion of the inner section. The mounting portion may accept the article and guide it along an arcuate path inwardly and into a deflection channel. The deflection channel may be disposed at an inward terminus of the mount acceptance channel and extend radially outward from the mount acceptance channel.

20 Claims, 36 Drawing Sheets

(56) References Cited

U.S. PATENT DOCUMENTS

| | | | | |
|---|---|---|---|---|
| 2005/0077332 | A1 | 4/2005 | Parsons | |
| 2007/0235481 | A1 | 10/2007 | Parsons | |
| 2007/0278266 | A1 | 12/2007 | Parsons | |
| 2010/0275418 | A1 | 11/2010 | Ingram | |
| 2012/0037673 | A1 | 2/2012 | Chen et al. | |
| 2012/0266352 | A1* | 10/2012 | Busch | F16B 21/09 2/102 |
| 2015/0351522 | A1 | 12/2015 | Smith | |
| 2016/0316900 | A1 | 11/2016 | Hanchett et al. | |

* cited by examiner

WEARABLE WAFER TURN CLIP AND RELATED APPARATUS, SYSTEMS, AND METHODS

CROSS-REFERENCE TO RELATED APPLICATION

This application claims priority to, and the benefit of, U.S. patent application Ser. No. 14/697,442 entitled "WEARABLE WAFER TURN CLIP" filed on Apr. 27, 2015, which claims priority to, and the benefit of, U.S. Provisional Application Ser. No. 62/117,258 entitled "WEARABLE WAFER TURN CLIP" filed on Feb. 17, 2015, the contents of both hereby incorporated herein by reference in their entirety for any purpose.

FIELD OF INVENTION

The present invention relates to the field of connectors. More particularly, the present invention relates to a clip connector.

BACKGROUND

Clips have long been used to connect items together. For instance, spring loaded compressive clips have often been used to attach items, such as smart phones, electronic devices, and the like to an operator's clothing. Traditional clipping systems may provide a pinching and/or compressing grasping feature at the outward terminus of a linear mount acceptance channel opposite a flange support; carrying a load between the flange support and the grasping feature subjecting the clip to pivoting and loose perpendicular and/or lateral movement making the clip prone to popping off and requiring a variety of structural configurations to support a variety of devices. Such a configuration provides a single linear, usually perpendicular method of attachment which may be prone to disengagement in all but one axis. Such a configuration makes it difficult for an article to pass into the mount acceptance channel during attachment; due to the resistance provided by the grasping feature located at the entry to the mount acceptance channel. An operator must provide significant force to apply the device to an article. Such a configuration may result in mechanical hinges or tabs, to mitigate the force application, providing protruding surfaces and/or a bulky device which uncomfortable to wear and/or operate. Moreover, such a configuration provided with hinges requires assembly in production.

SUMMARY OF THE INVENTION

A wearable wafer turn clip is disclosed. The wearable wafer turn clip may include a body ring having an arcuate boss forming at least a partial annulus, a grip ring including an arcuate flange disposed radially outward of the body ring along at least a portion of an outer circumference of the body ring and, in various embodiments, forming a radially outermost edge of the wearable wafer turn clip, and an inner section having a flange extending from the body ring inwardly into a center area of the at least partial annulus of the body ring. The wearable wafer turn clip may have a mount acceptance channel having an arcuate channel defined by a radially inward edge of the body ring and a radially outward edge of at least a portion of the inner section. The wearable wafer turn clip may have a deflection channel including an arcuate channel disposed at an inward terminus of the mount acceptance channel and extending at least partially radially outward from the mount acceptance channel. The mounting portion may be configured to accept an article inserted between the body ring and the inner section whereby the wearable wafer turn clip is configured to selectably mechanically engage with the article.

A wearable wafer turn clip mounting system is disclosed. The wearable wafer turn clip mounting system may include a wearable wafer turn clip and a device mount. The wearable wafer turn clip may include a body ring having an arcuate boss forming at least a partial annulus, an inner section including a flange extending from the body ring inwardly into a center area of the at least partial annulus of the body ring, and a mounting portion having a channel defined by a radially inward edge of the body ring and a radially outward edge of at least a portion of the inner section. The wearable wafer turn clip may also include a receptacle slot having a cylindrical boss extending axially from the inner section and defining a cylindrical void, and a device mount rotatably interconnected to the wearable wafer turn clip and having an interface boss inserted into the receptacle slot. The device mount may be configured to retain a device in securement to the device mount, and the mounting portion may be configured to accept an article inserted between the body ring and the inner section whereby wearable wafer turn clip is selectably mechanically engagable with the article.

A method of donning a wearable wafer turn clip, the method including inserting an article into a mount acceptance channel between a body ring and an inner section of a wearable wafer turn clip. The body ring may include an arcuate boss forming at least a partial annulus and the inner section may include a flange extending from the body ring inwardly into a center area of the at least partial annulus of the body ring. The method may include rotating the wearable wafer turn clip by grasping a grip ring forming an arcuate flange disposed radially outward of the body ring along at least a portion of an outer circumference of the body ring, the grip ring forming a radially outermost edge of the wearable wafer turn clip. The method may include engaging the article in a deflection channel forming an arcuate channel disposed at an inward terminus of the mount acceptance channel and extending at least partially radially outward from the mount acceptance channel.

A wearable wafer turn clip is disclosed. The wearable wafer turn clip may include a body ring including an arcuate boss forming at least a partial annulus. The wearable wafer turn clip may also include an inner section forming a flange extending from the body ring inwardly, a mount acceptance channel including an arcuate channel defined by at least one of the body ring and the inner section and a deflection channel extending at least partially outward from the mount acceptance channel and adjacent the inner section flange. The deflection channel may be configured to mechanically engage with an article within the deflection channel.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for manufacturing and construction may not be described in detail herein. Furthermore, the connecting lines shown in various Figures contained herein are intended to represent exemplary functional relationships and/or physical couplings between various elements. It should be noted that many alternative or additional functional relationships or physical connections may be present in a practical method of construction and/or usage. As used herein, a first item is "adjacent to" a second item when the first item is proximate to and sharing at least a portion of a side with the second item.

Various systems, apparatuses, and methods to address the challenges of traditional clips are presented herein. There is a need for a wearable wafer clip which restricts both lateral and perpendicular movement by providing a bending, binding, compressing and deflecting grasping feature adjacent to a flange support at an inward terminus of an arching mount acceptance channel; thereby carrying the load below both flange support and grasping feature providing a secure, versatile, and adaptable attachment in a single structural configuration to support a variety of devices. There is a need for a wearable wafer clip which is rotationally applied and allows an article to pass into a mount acceptance channel without mechanical hinges and without resistance thereby making the wearable wafer clip ergonomic to apply thru gradual pressure and natural arm angles, and in various embodiments, without post manufacturing assembly. There is a need for a wearable wafer clip with a generally thin and radial configuration such as to eliminate protruding surfaces thereby making the wearable wafer clip more comfortable to wear and operate. There is a need for a wearable wafer clip which provides multiple mechanisms of securing to an article as will be discussed. Moreover, there is a need for a wearable wafer clip to securely retain a plurality of adaptors and devices as also will be discussed.

Figure 1A:
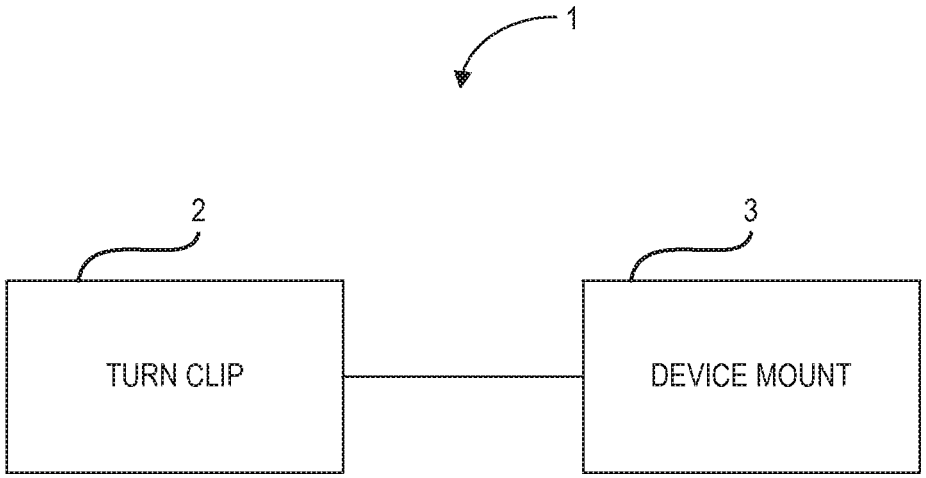
FIG. 1A is a block diagram of a wearable wafer turn clip mounting system in accordance of with various embodiments.
Figure 1B:
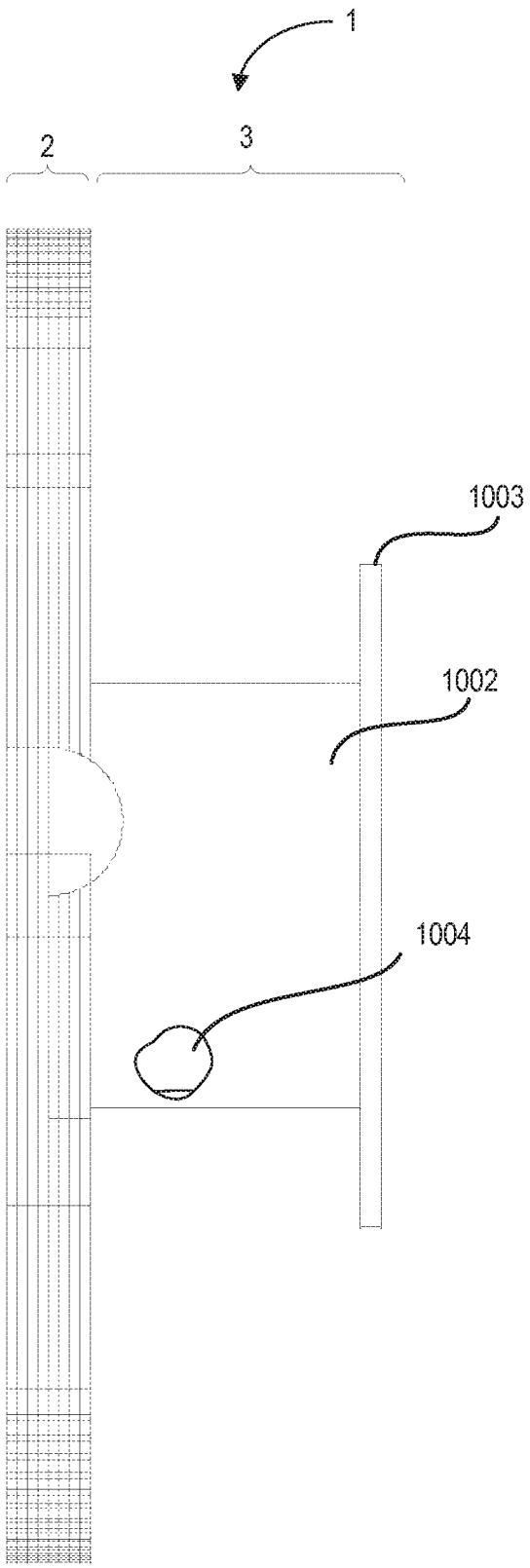
FIG. 1B depicts a wearable wafer turn clip and device mount wherein the device mount comprises a female portion and the wearable wafer turn clip comprises a male portion in accordance of with various embodiments.

In accordance with various embodiments, and with reference to FIG. 1A, a wearable wafer turn clip 2 is disclosed. A wearable wafer turn clip mounting system 1 may comprise a wearable wafer turn clip 2 and a device mount 3. Furthermore, a device mount 3 is disclosed, which may be a part of wearable wafer turn clip mounting system 1. A wearable wafer turn clip mounting system 1 may comprise a mechanism for attaching a device to an external article, object or surface. The wearable wafer turn clip mounting system 1 may comprise multiple mechanisms of effectuating attachment, as will be discussed. Mechanisms for effectuating attachment may include mounting portions such as mount acceptance channels and deflection channels, inner sections, radial arms and central bosses, tip engagements, apertures, and the like, as will be discussed herein. Multiple of such mechanisms may be effectuated by a unitary body, such as a one-piece apparatus. Moreover, the wearable wafer turn clip mounting system 1 may be may be both attached and handled ergonomically and securely and may in various embodiments further provide a stand or support structure.

A wearable wafer turn clip mounting system 1 may comprise a wearable wafer turn clip 2 and a device mount 3. The wearable wafer turn clip 2 and the device mount 3 may be interconnected. In various embodiments, this interconnection is fixed, so that the wearable wafer turn clip 2 and device mount 3 are fixed in position relative to each other. In various embodiments, this interconnection is selectably movable, such as so that the wearable wafer turn clip 2 and the device mount 3 may be selectably shifted relative to one another, for instance, selectably rotated. In various embodiments, this interconnection is continuously selectably adjustable, and in further embodiments, this interconnection is adjustable only to certain positions, such as may be set by detents and/or the like.

Figure 16A:
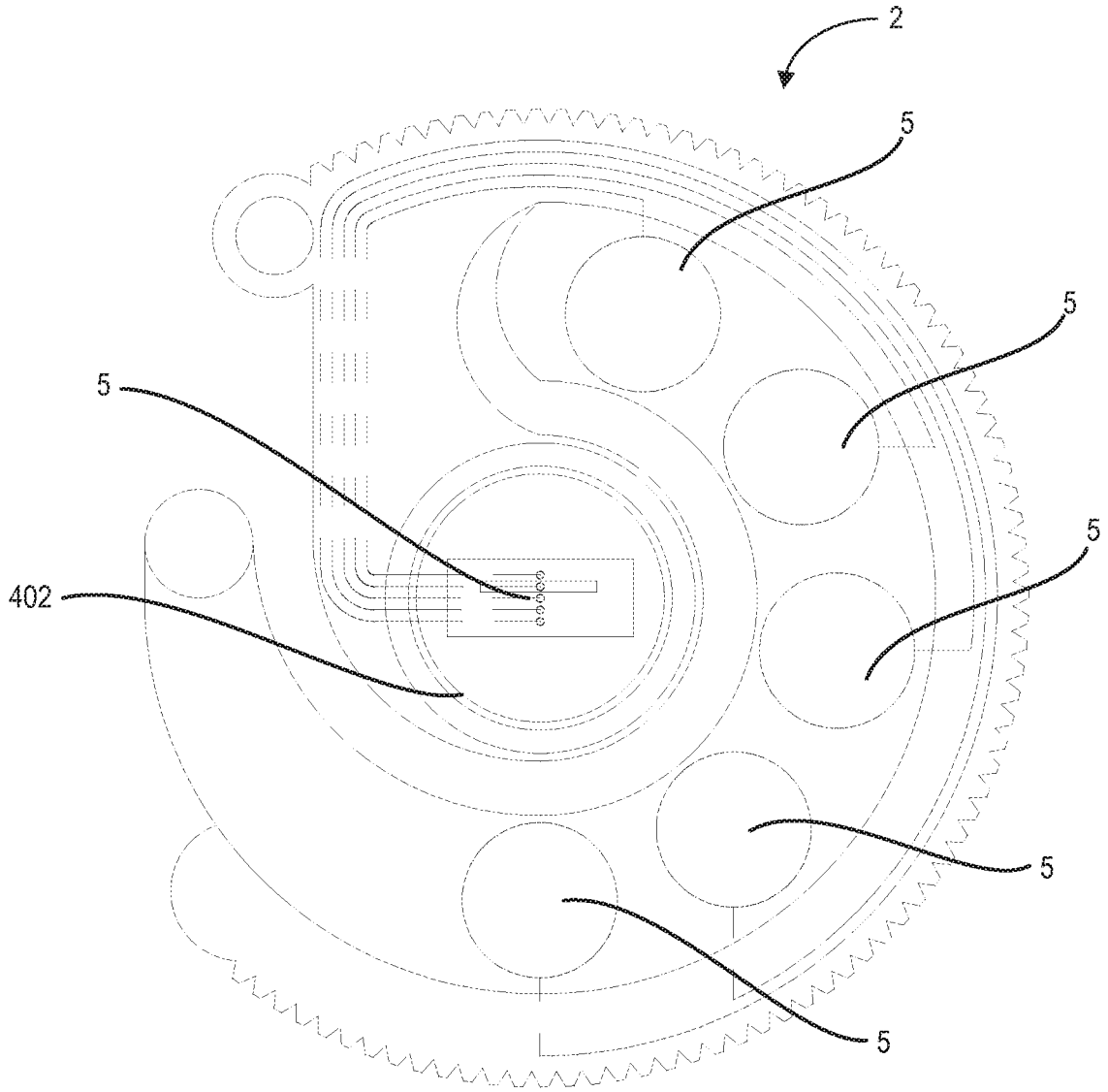
FIGS. 16A-B depict views of a wearable wafer turn clip having a single wrap channel and a curved wedge, further having enhancement features comprising embedded electronics, according to various embodiments.

The wearable wafer turn clip 2 may retain a device in securement to the wearable wafer turn clip mounting system 1. For instance, the wearable wafer turn clip 2 may itself retain an electronic device, such as a wearable computer, a smart phone, a telecommunications device, and the like. With momentary reference to FIG. 3B, 16A and 17, the wearable wafer turn clip 2 may comprise embedded electronics, for instance, may itself comprise a wearable computer. The wearable wafer turn clip 2 may comprise any substrates, adhesive or mechanical fastener configured to retain a desired peripheral device in securement to the wearable wafer turn clip mounting system 1 as desired. For example, a small sensor chemically bonded or fastened thru an aperture to the inner section of wearable wafer clip 2 whereas the device is directly attached to or embedded within wearable wafer clip 2.

Figure 23:
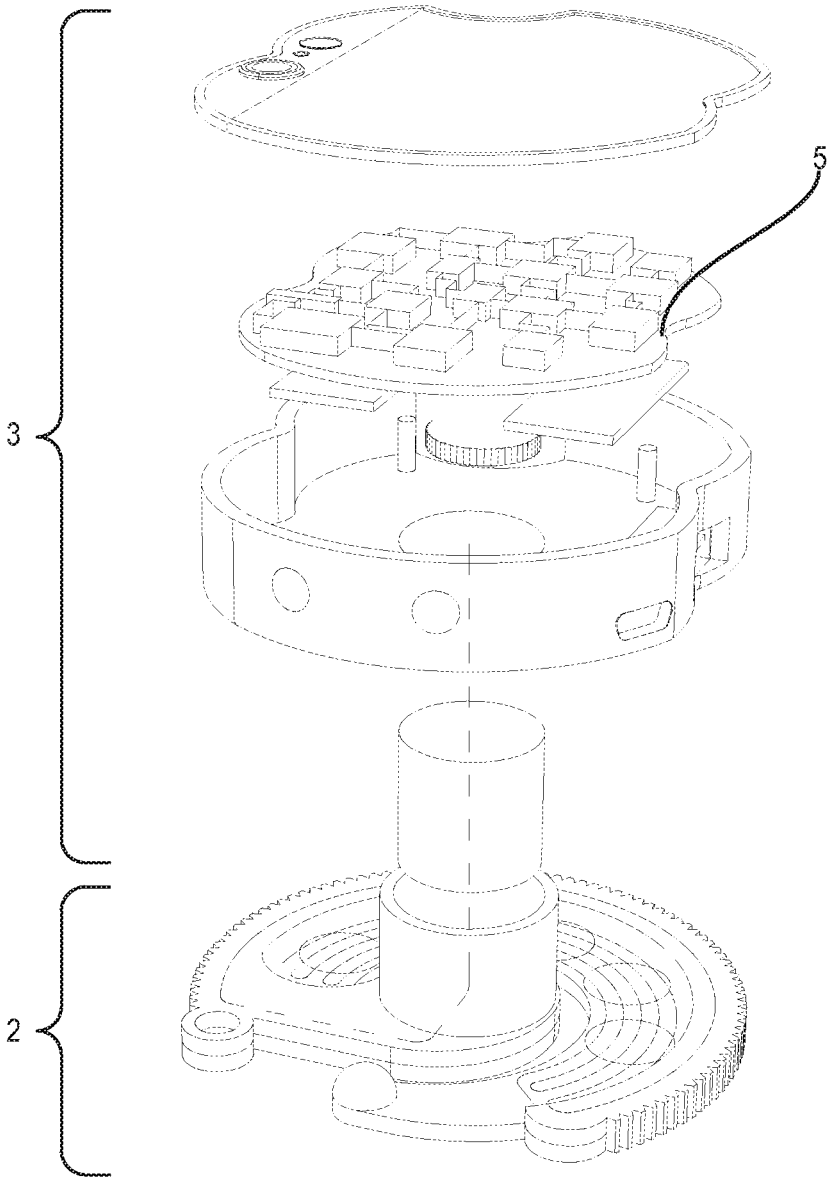
FIG. 23 depicts a device mount comprising embedded electronics, according to various embodiments.

The device mount 3 may retain a device in securement to the wearable wafer turn clip 2. For instance, the device mount 3 may retain an electronic device, such as a wearable computer, a smart phone, a telecommunications device, and the like. With momentary reference to FIG. 23, the device mount 3 may comprise embedded electronics, for instance, may itself comprise a wearable computer. The device mount 3 may comprise any structure designed and configured to retain a desired peripheral device in securement to the wearable wafer turn clip mounting system 1 as desired. For example, a device mount 3 may further comprise an extensible, adjustable, expandable, and/or contractible member whereby the orientation and positioning of a device retained in the device mount 3 may be varied relative to a wearable wafer turn clip 2 of a wearable wafer turn clip mounting system 1.

The wearable wafer turn clip 2 may retain the wearable wafer turn clip mounting system 1 in securement to an external object. For instance, the wearable wafer turn clip 2 may retain the wearable wafer turn clip mounting system 1 in securement to clothing, such as a waistband of pants, or to a pocket of a shirt, or to a sleeve. The wearable wafer turn clip 2 may retain the wearable wafer turn clip mounting system 1 ergonomically and securely and may be securable to flexible clothing, inflexible clothing, belts, bands, seams, collars, cords, straps, pockets, purses, and/or the like. Such attachment may facilitate freeing of both hands, such as during actions wherein the operator desires both hands free, such as when driving a vehicle. In further embodiments, the wearable wafer turn clip 2 may retain the wearable wafer turn clip mounting system 1 in securement to any support, such as to the edge of a surface, or to a stake, or to a tripod, and/or metallic surfaces, such as by attached magnets, and/or the like. The wearable wafer turn clip 2 may have assistive attachment features such as magnets, adhesives and/or the like.

Figure 1C:
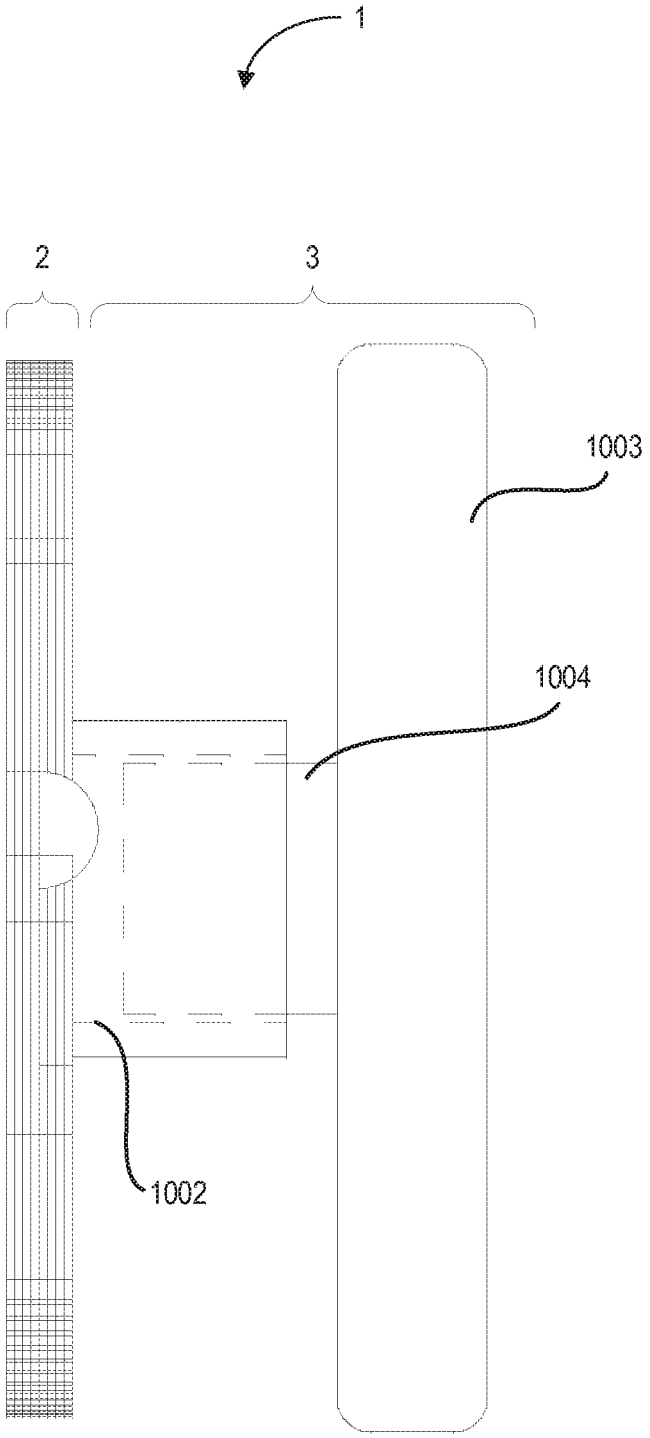
FIG. 1C depicts a wearable wafer turn clip and device mount wherein the device mount comprises a male portion and the wearable wafer turn clip comprises a female portion in accordance of with various embodiments.

With reference to FIGS. 1B-1J, a wearable wafer turn clip 2 and a device mount 3 may interconnect in various manners. For instance, with reference to FIG. 1B, a device mount 3 may comprise a receptacle slot 1002 and a mounting plate 1003. The receptacle slot 1002 may comprise a cylinder having a cylindrical void disposed therein, the cylinder attached and/or integrally formed to the mounting plate 1003. The receptacle slot 1002 may receive a portion of the wearable wafer turn clip 2, such as a corresponding interface boss 1004. With reference to FIG. 1C, in further embodiments, the device mount 3 may comprise the interface boss 1004 and the wearable wafer turn clip 2 may comprise the receptacle slot 1002. The device mount 3 may further comprise a structure to receive and/or support a device, such as mounting plate 1003 and/or other structures such as depicted in FIGS. 1D, and 18-26. For instance, a device support (such as integrated device case 12, pivotable device framework 17, coupled pin adaptor 18, coupled thread adaptor 19, coupled plug adaptor 20, coupled slot adaptor 21, device holster 22, drop strap adaptor 24, or slide clamp adaptor 27) may be configured to receive an interface boss 1004 insertable into a receptacle slot. In such embodiments, the interface boss 1004 of the wearable wafer turn clip 2 may be insertable into a corresponding void formed in and defined by the receptacle slot 1002. In further embodiments, such as with reference to FIG. 1D, a fastener 1005 and optionally a washer 1006 and/or bearing may further retain the interface boss 1004 and the receptacle slot 1002 together in rotatable communication. In still further embodiments, the interface boss 1004 may alternatively or additionally comprise an adhesively bonded or fastener attachable mount such in combination with integrally bonded mount 502 of FIG. 17.

Thus, as one may appreciate, the wearable wafer turn clip 2 may comprise a male portion and the device mount 3 a female portion. For instance, with momentary reference to FIG. 1E, the wearable wafer turn clip 2 may have threads 1009 disposed on a circumferentially outward surface of an interface boss 1004. With momentary reference to FIG. 1H, the wearable wafer turn clip 2 may have a fastener snap plug 1010 shaped in correspondence to a fastener snap slot 1011 of a device mount 3. With momentary reference to FIGS. 1I-J, the wearable wafer turn clip 2 may have a partial turn fastener flange 1012 configured to be received into a spring-loaded partial turn channel 1013 of a device mount 3. By rotating the partial turn fastener flange 1012 a partial turn relative to the spring-loaded partial turn channel 1013, the partial turn fastener flange 1012 and spring-loaded partial turn channel 1013 may be joined in selectably fixed mechanical communication.

In further embodiments, the wearable wafer turn clip 2 may comprise a female portion and the device mount 3 a male portion. For instance, with momentary reference to FIG. 1F, the wearable wafer turn clip 2 may have threads 1009 disposed on a circumferentially inward surface of a receptacle slot 1002. With reference to FIG. 1G, the wearable wafer turn clip 2 may have a fastener snap plug 1010 shaped in correspondence to a fastener snap slot 1011 of a device mount 3.

Figure 1D:
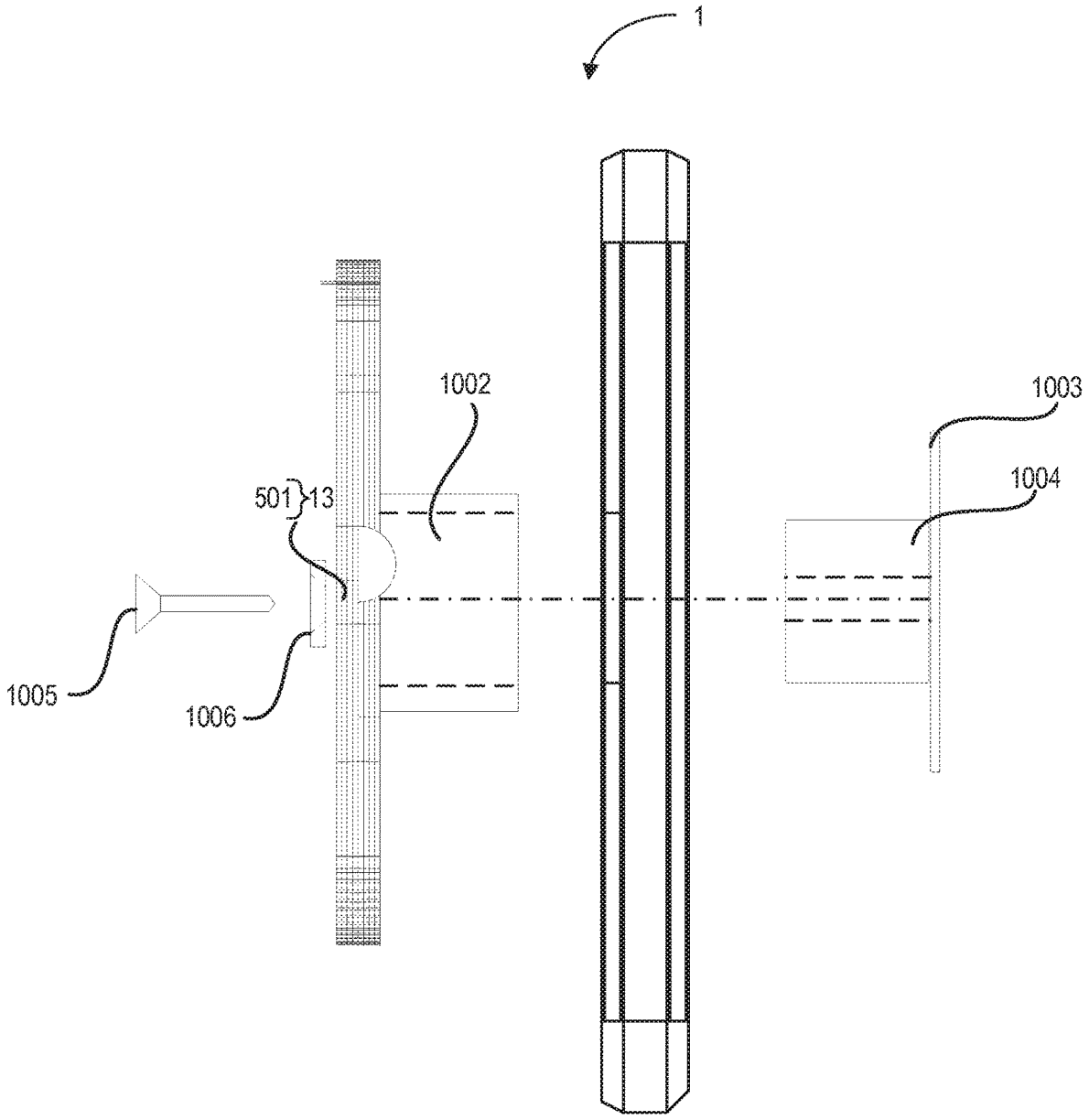
FIG. 1D depicts an exploded view of an example wearable wafer turn clip and device mount joined together, in accordance of with various embodiments.
Figure 1E:
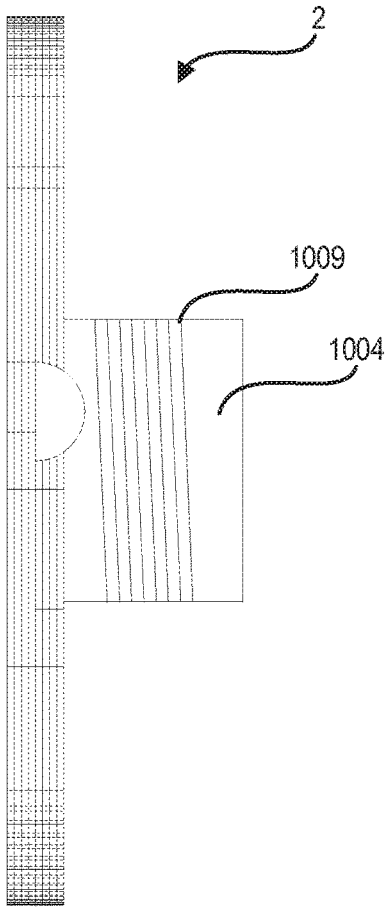
FIGS. 1E-F depict example wearable wafer turn clips having threads, in accordance with various embodiments.
Figure 1F:
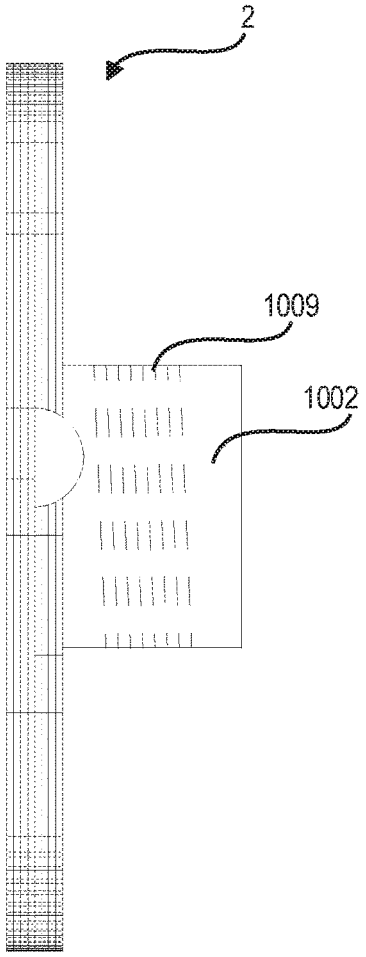
Figure 1G:
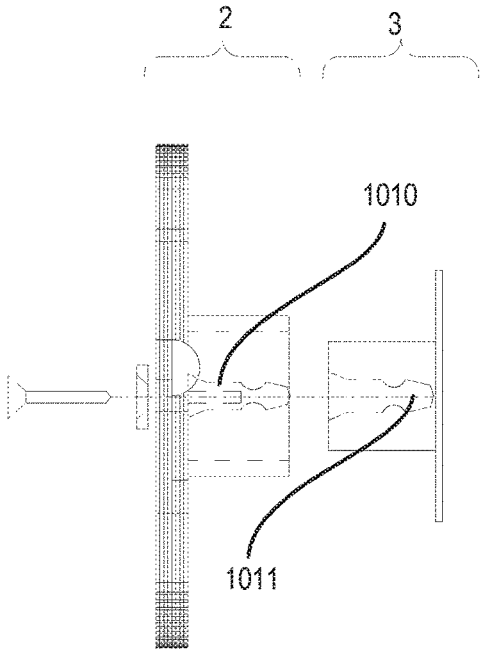
FIGS. 1G-H depict example wearable wafer turn clips having fastener snap plugs, in accordance with various embodiments.
Figure 1H:
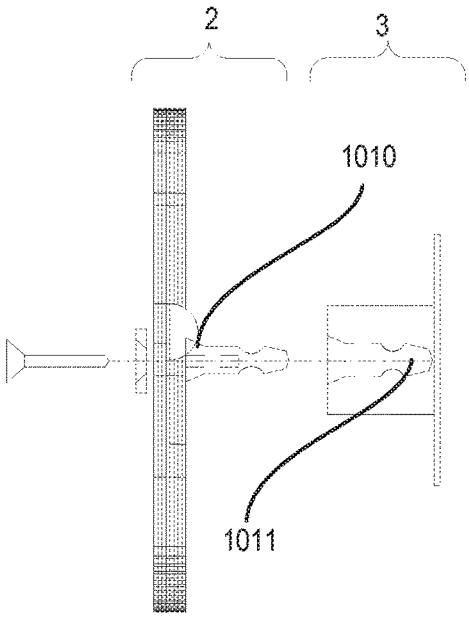
Figure 1I:
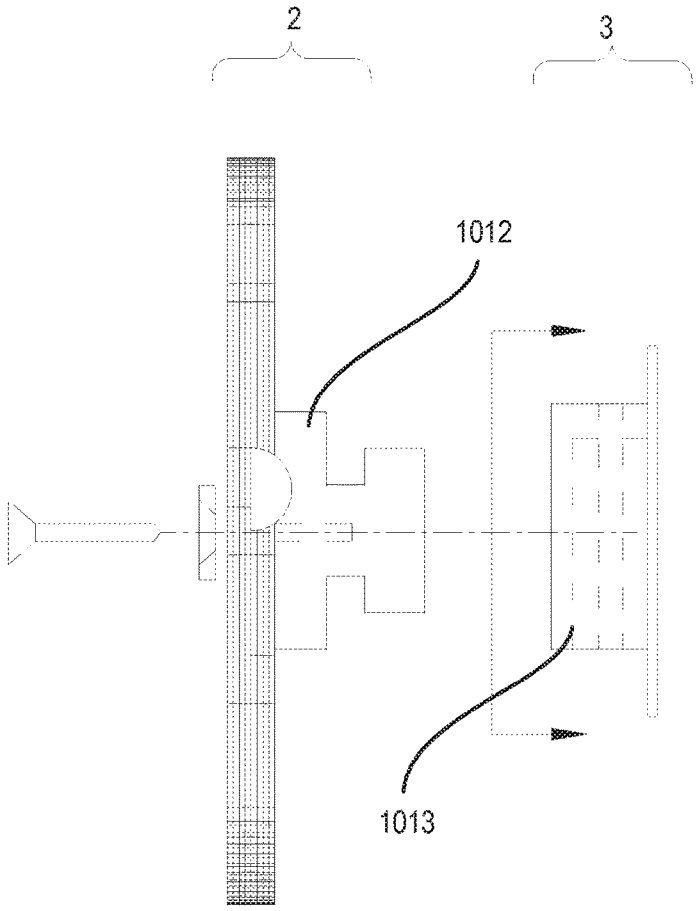
FIGS. 1I-J depict an example wearable wafer turn clip and device mount having a partial turn fastener flange and a spring loaded partial turn channel, in accordance with various embodiments.
Figure 1J:
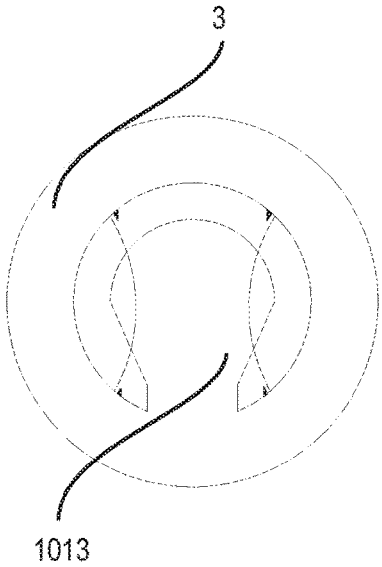

With reference to FIG. 1D, in various embodiments, the receptacle slot 1002 receives the interface boss 1004 and a fastener 1005, such as a pin, screw, post, etc., is inserted or affixed through a washer 1006, the united receptacle slot 1002 and interface boss 1004. In further embodiments, the fastener 1005 comprises corresponding threads, slots, grooves, and the like of the interface boss 1004 and the receptacle slot 1002. In various embodiments, the washer may comprise a magnet, such as to facilitate mounting of the system 1 to an object or surface.

Figure 2:
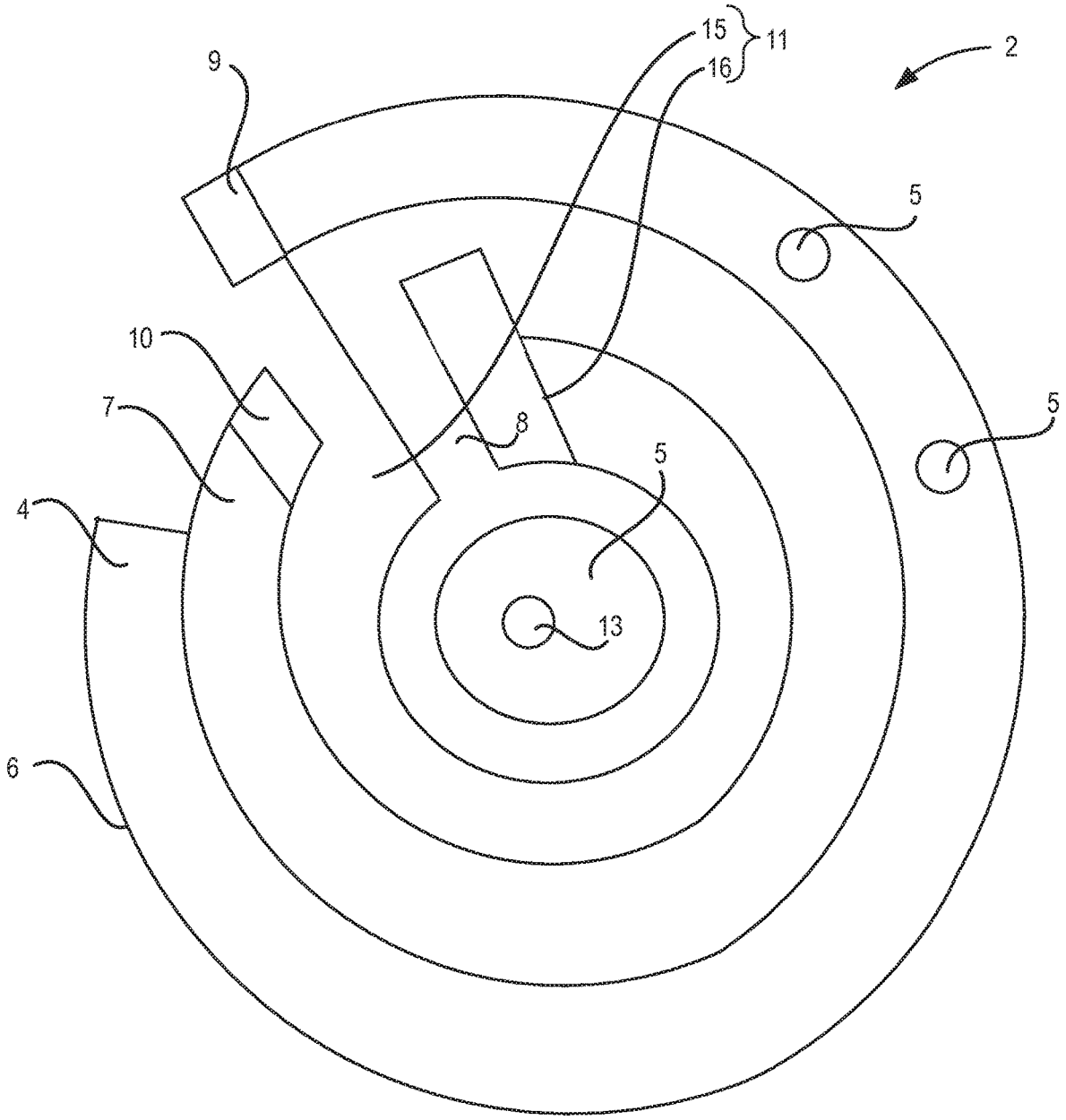
FIG. 2 depicts a block diagram of a wearable wafer turn clip in accordance with various embodiments.

Having generally discussed the wearable wafer turn clip mounting system 1, specific attention is directed to FIG. 2 and the wearable wafer turn clip 2. In various embodiments, the wearable wafer turn clip 2 may comprise a substantially circular boss structure. The wearable wafer turn clip 2 may comprise various features.

Figure 12:
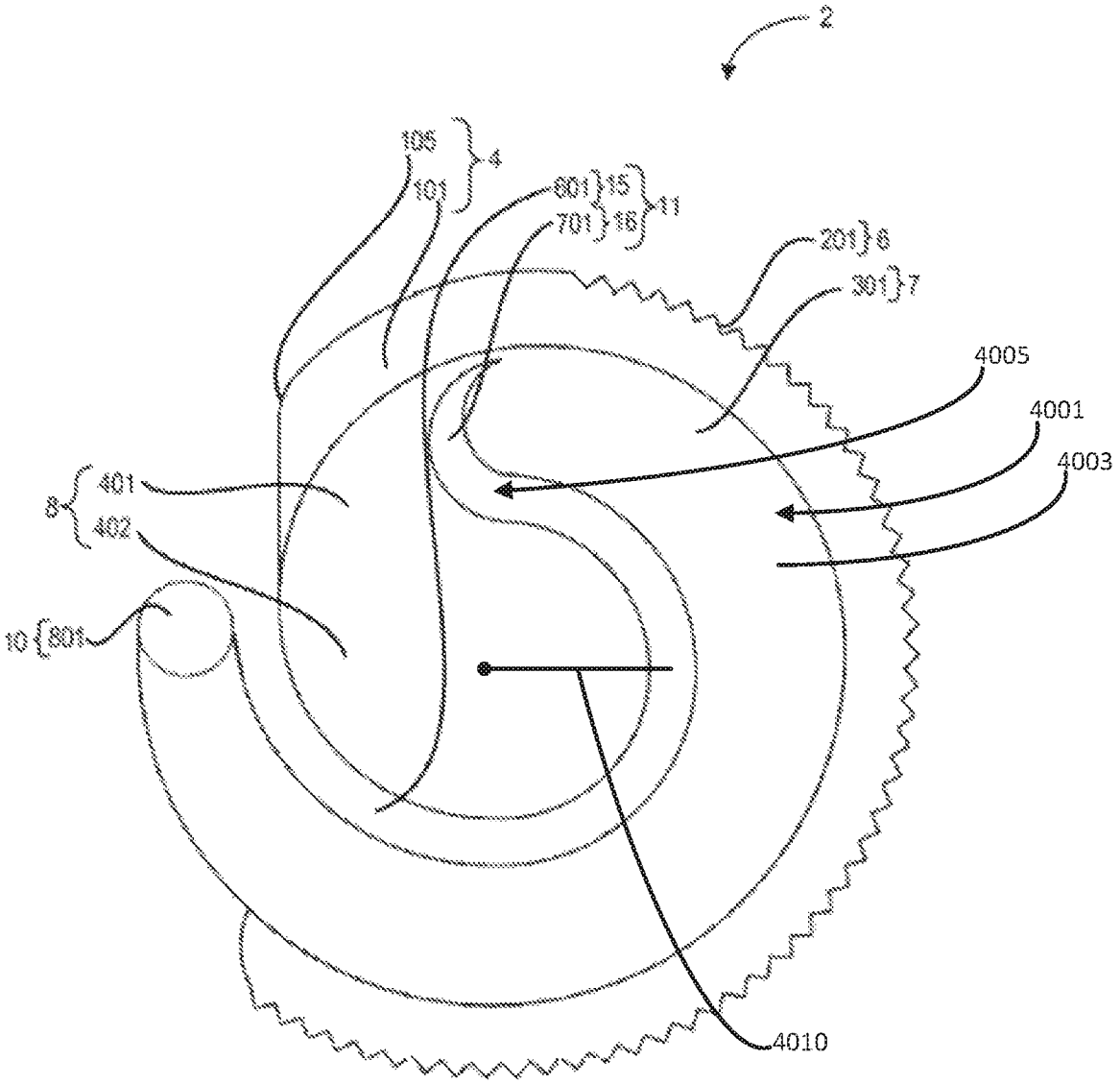
FIG. 12 depicts a view of a wearable wafer turn clip having a grip ring guidance face and an inner section comprising an arcuate radial arm in accordance with various embodiments.

The wearable wafer turn clip 2 may comprise a body ring 7. A body ring 7 may comprise the primary structural member of the wearable wafer turn clip 2. The body ring 7 may comprise a substantially arcuate boss 4001 (FIG. 12) forming at least a portion of an annulus 4003 (FIG. 12). The body ring 7 may form at least a portion of a constant radius annulus, or may form at least a portion of a variable radius annulus (e.g., spiral) or may form any shape as desired. The grip ring 4 may be circumferentially about a portion of the body ring 7 and radially outward of the body ring 7.

The wearable wafer turn clip 2 may comprise a grip ring 4. A grip ring 4 may comprise an arcuate flange disposed along a radially outermost edge of the wearable wafer turn clip 2. The grip ring 4 may be disposed radially outward of the body ring 7 along at least a portion of an outer circumference of the body ring 7. The grip ring 4 may provide a surface for an operator to grasp, hold, and/or operate, such as to rotate the wearable wafer turn clip 2, for instance, to interlock the wearable wafer turn clip 2 with an article to which it is being mounted. In various embodiments, a grip ring 4 may comprise any shape as desired such as to form a handle, apron, band, batten, belt, boss, crenation, felly, frame, channel, and/or the like whereby the wearable wafer turn clip 2 may be grasped by an operator. A grip ring 4 may comprise various coatings and materials, such as rubber, frictional material, and/or the like.

The wearable wafer turn clip 2 may comprise a manipulation surface 6. A manipulation surface 6 may comprise an arcuate surface disposed on the radially outermost edge of the grip ring 4. The manipulation surface 6 may comprise a frictional material configured to increase the frictional engagement of the wearable wafer turn clip 2 to an operator's fingers such as during grasping and/or other operations. The manipulation surface 6 may comprise a serrated edge, or may comprise alternating bosses and channels or may comprise any frictional surface as desired.

Moreover, the wearable wafer turn clip 2 may comprise an inner section 8. An inner section 8 may comprise a cantilever. For example, an inner section 8 may comprise a flange extending from the body ring 7 inwardly into the center area of the annulus formed by the body ring 7. Thus the inner section 8 may be said to have a flange and an inner section center area. The inner section 8 may comprise a spring member, for instance, to exert a compressive force along an axial path of the body ring 7 on an article inserted between the body ring 7 and the inner section 8 and lying generally in a circumferential plane of the body ring 7. Thus, the inner section 8 may interact with the body ring 7 to squeeze an article inserted between the body ring 7 and the inner section 8.

The wearable wafer turn clip 2 may comprise a device mount receiving member 13. The device mount receiving member 13 may comprise an apparatus configured to interface with the device mount 3 (FIG. 1A) and hold the wearable wafer turn clip 2 and the device mount 3 (FIG. 1A) in mechanical communication. For instance, and with momentary additional reference to FIGS. 1D, 2, 3A, and 24, device mount receiving member 13 may comprise an aperture 501 disposed through the wearable wafer turn clip 2 and configured to receive a fastener 1005.

The wearable wafer turn clip 2 may comprise a carrying fixture 9. A carrying fixture 9 may comprise a boss disposed on the radially outermost side of at least one of the grip ring 4 and the body ring 7. The carrying fixture 9 may comprise a fixture whereby an operator may carry the wearable wafer turn clip 2. For instance, in various embodiments, the carrying fixture 9 may comprise a ring and aperture, such as for insertion of a lanyard, karabiner, key ring, string, chain, enhancement feature, further retention mechanism, and/or the like. A wearable wafer turn clip 2 may comprise one or more carrying fixture 9 located in any position on the wearable wafer turn clip 2 as desired.

The wearable wafer turn clip 2 may comprise a tip engagement 10. A tip engagement 10 may comprise an integral volume of the body ring 7. In further embodiments, a tip engagement 10 may be fastened to the body ring 7 rather than integrally formed. The body ring 7 may comprise a partial annulus and the tip engagement 10 may be disposed at a circumferential end of the body ring 7. A tip engagement 10 may comprise a thickening of the body ring 7, such as an axially extending boss, bump, half-hemisphere, and/or the like. The tip engagement 10 may comprise any structure configured to frictionally engage with the article inserted between the body ring 7 and the inner section 8. For instance, the article may comprise a portion of a pants pocket. The tip engagement 10 may frictionally engage the edge of the pants pocket, such as binding within the corner of the pocket and thereby ameliorating the possibility of the wearable wafer turn clip 2 inadvertently disengaging from the article. Moreover, the tip engagement 10 may comprise any structure configured to provide tactile feedback to an operator's fingers, and improve the grasping of the wearable wafer turn clip 2.

The wearable wafer turn clip 2 may comprise a mounting portion 11. A mounting portion 11 may comprise a channel defined by and through the radially inward edge of the body ring 7 and the radially outward edge of the inner section 8. The mounting portion 11 may be configured to accept the article inserted between the body ring 7 and the inner section 8 to which the wearable wafer turn clip 2 is desired to be engaged. The mounting portion 11 may be configured to accept an article inserted between the body ring 7 and the inner section 8, whereby the wearable wafer turn clip 2 is selectably mechanically engagable and disengagable with the article. In this manner, the wearable wafer turn clip 2 may be selectably attached to the article.

The mounting portion 11 may comprise various different portions. For instance, the mounting portion 11 may comprise a mount acceptance channel 15 and a deflection channel 16. The mount acceptance channel 15 may comprise an arcuate channel having a constant radius, for instance, an arc length of a circle co-axial with the center of the wearable wafer turn clip 2 (see FIG. 12). The mount acceptance channel 15 may receive an article to which the wearable wafer turn clip 2 is desired to be engaged. For instance, the article may be inserted into the mount acceptance channel 15 proximate to the radially outermost edge of the body ring 7 and/or the grip ring 4. The article may travel inward along the mount acceptance channel 15 as the wearable wafer turn clip 2 is rotated by an operator and may then enter the deflection channel 16. The deflection channel 16 may comprise a channel disposed at or near the inward terminus of the mount acceptance channel 15 (e.g., end of the channel opposite the end proximate to the radially outermost edge of the body ring 7 and/or the grip ring 4). In various embodiments, the deflection channel 16 is disposed about ¾-pi-radians to 1¼-pi-radians away from the distal end of the mount acceptance channel 15. In various embodiments, the deflection channel 16 is disposed about ¼-pi-radians to 1¾-pi-radians away from the distal end of the mount acceptance channel 15. In further embodiments, the deflection channel 16 is disposed about one-pi-radian away from the distal end of the mount acceptance channel 15. In this manner, an article secured in the deflection channel 16 must travel an arcuate path about the central axis of the wearable wafer turn clip 2 in order to exit therefrom. As such, the tendency of the article to disengage from the wearable wafer turn clip 2 is further ameliorated and the tendency of an article, once disengaged from the deflection channel 16 to inadvertently disengage entirely from the wearable wafer turn clip 2 is further ameliorated.

The deflection channel 16 may comprise a channel of at least one of variable thickness, differing thickness relative to the mount acceptance channel 15, and/or a point of inflection (see FIG. 12, point of inflection 4005 at the inward terminus of the mount acceptance channel 15) relative to the mount acceptance channel 15. For instance, while the mount acceptance channel 15 may extend generally circumferentially, the deflection channel 16 may extend generally radially. As such, the article may be deflected and/or pinched (e.g., frictionally engaged, whether through binding, orthogonal binding such as via the transition from a circumferential mount acceptance channel 15 to a radial deflection channel 16, bending, compressing, and/or deflecting along a vector lying in a circumferential plane, and/or the like) by the deflection channel 16. In this manner, the tendency of the article to disengage from the wearable wafer turn clip 2 may be ameliorated.

Thus, one may appreciate that at least three features of the wearable wafer turn clip 2 independently ameliorate the tendency of the article to disengage from the wearable wafer turn clip 2. For instance, the inner section 8 and the body ring 7 may engage the article in compression along an vector at least generally parallel the axis of the body ring 7 (and thus the wearable wafer turn clip 2), the tip engagement 10 may frictionally engage with the article such as binding within a corner of the article, and the deflection channel 16 may deflect and/or pinch the article (e.g., frictionally engage, whether through binding, orthogonal binding such as via the transition from a circumferential mount acceptance channel 15 to a radial deflection channel 16, bending, compressing, and/or deflecting along a vector lying in a circumferential plane, and/or the like).

Figure 5:
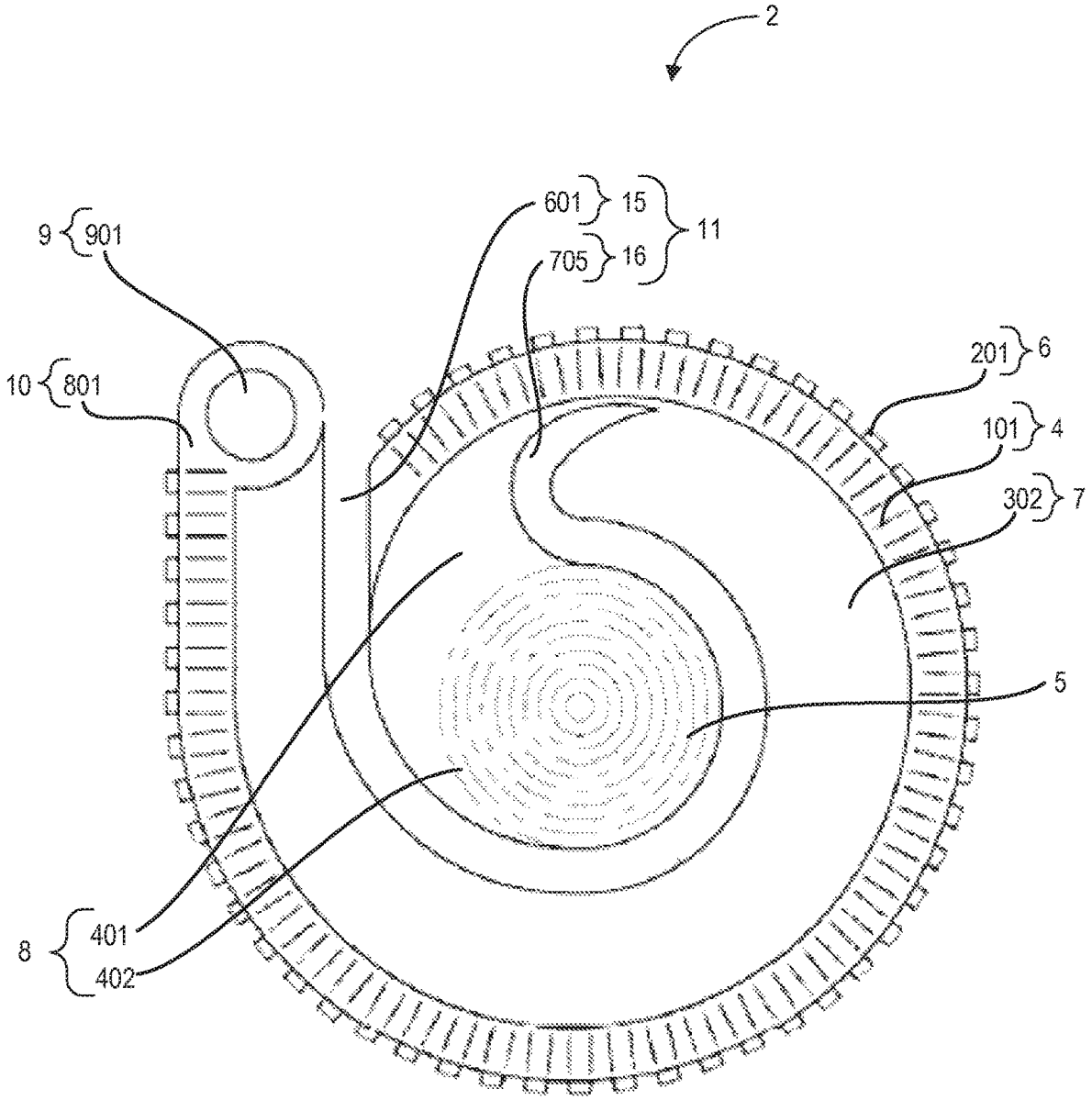
FIG. 5 depicts a view of a wearable wafer turn clip having a deflection channel comprising a reflected deflection channel according to various embodiments.
Figure 8:
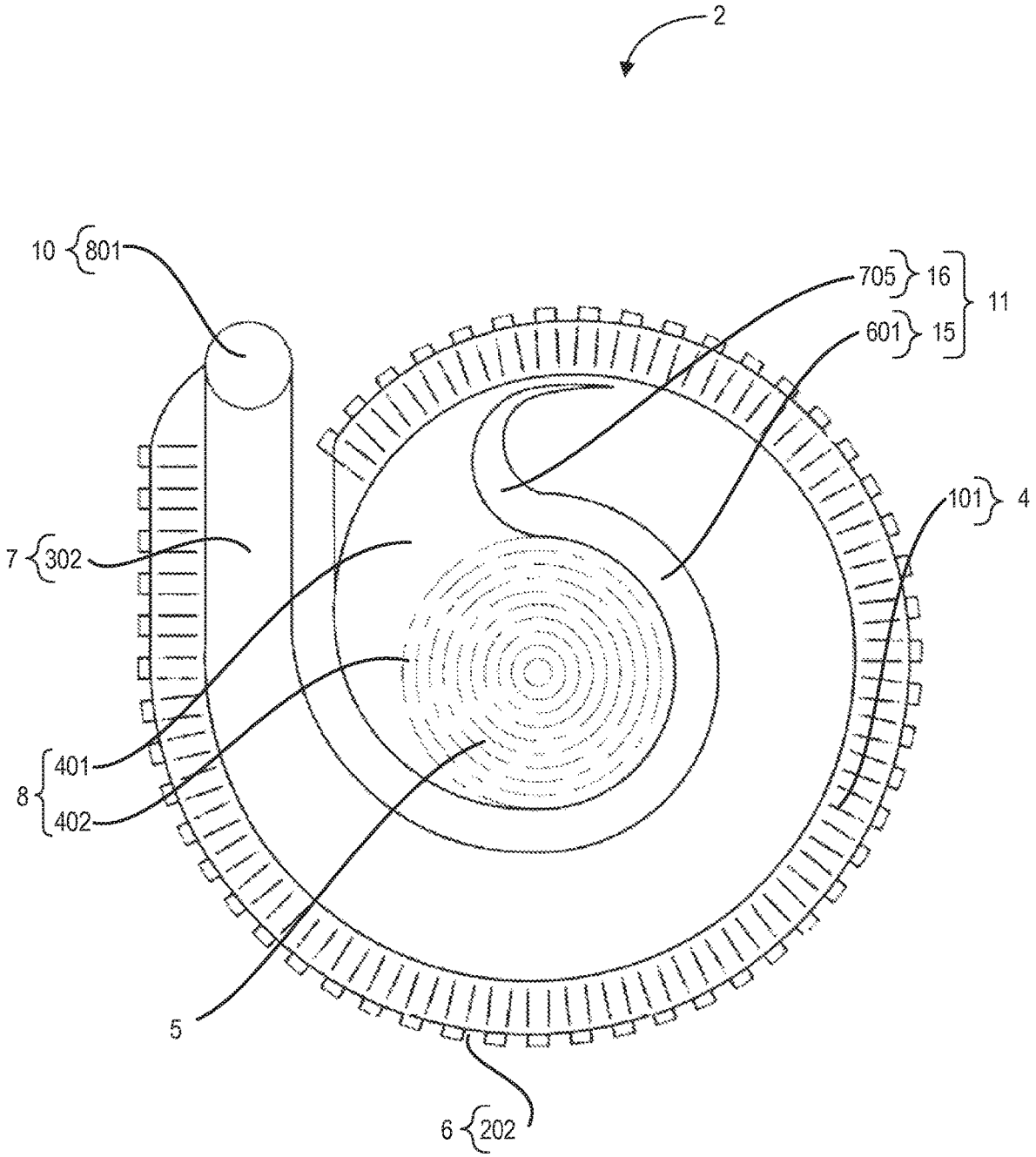
FIG. 8 depicts a view of a wearable wafer turn clip having a body ring comprising a single wrap with arm body ring and a reflected deflection channel in accordance with various embodiments.

Having discussed various specific features of the wearable wafer turn clip 2, attention is directed now to specific embodiments of the grip ring 4 of the wearable wafer turn clip 2. With reference to FIGS. 3A-6 and 8-15, a grip ring 4 may comprise a circumferential grip ring 101. A circumferential grip ring 101 may comprise a partial annulus of material disposed radially outward of the body ring 7 and circumferentially encircling a portion of the body ring 7. The circumferential grip ring 101 may comprise a constant radius partial annulus, or in further embodiments, may comprise a variable radius partial annulus. Moreover, in various embodiments, the circumferential grip ring 101 may comprise portions having a generally radial and/or tangential component, such as shown in FIGS. 5 and 8, wherein the circumferential grip ring 101 is radially outward of a body ring 7 that comprises a single wrap with arm body ring 302, wherein the body ring 7 has a radial/tangential arm with the circumferential grip ring 101 disposed circumferentially outward along an edge of the body ring 7.

Figure 11:
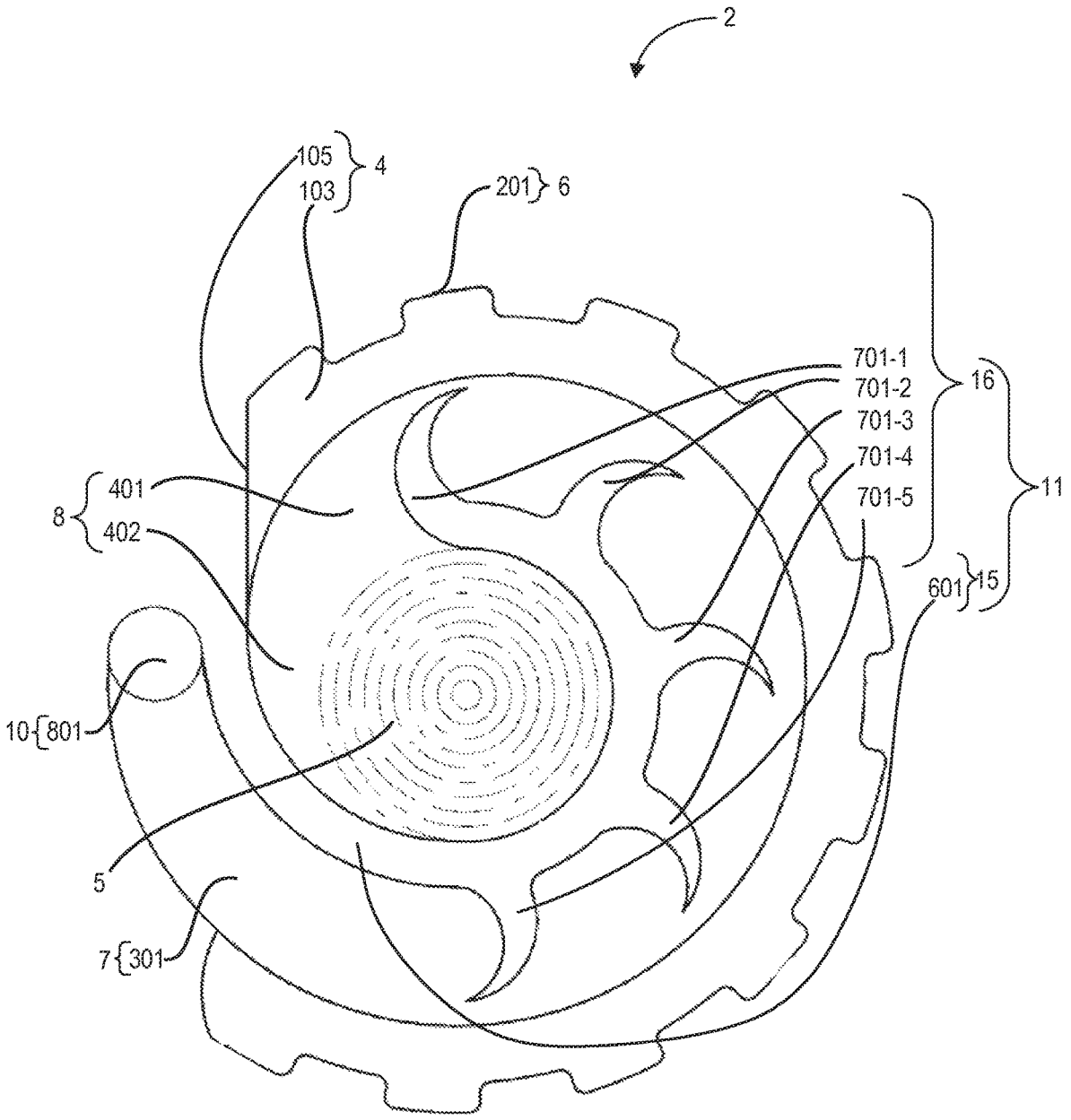
FIG. 11 depicts a view of a wearable wafer turn clip having a deflection channel comprising a plurality of curved wedges, in accordance with various embodiments.

With reference to FIG. 11, the grip ring 4 may comprise a segmented grip ring 103. For instance, the segmented grip ring 103 may comprise a plurality of partial annuluses of material disposed radially outward of the body ring 7 and circumferentially encircling a portion of the body ring 7. Each partial annulus may extend radially outward of the body ring 7. Thus, the projected edge of the wearable wafer turn clip 2 may comprise local discontinuities, such that the edge comprises both circumferentially extending portions and radially extending portions (e.g., at the distal end of each partial annulus of the segmented grip ring 103.

Figure 7:
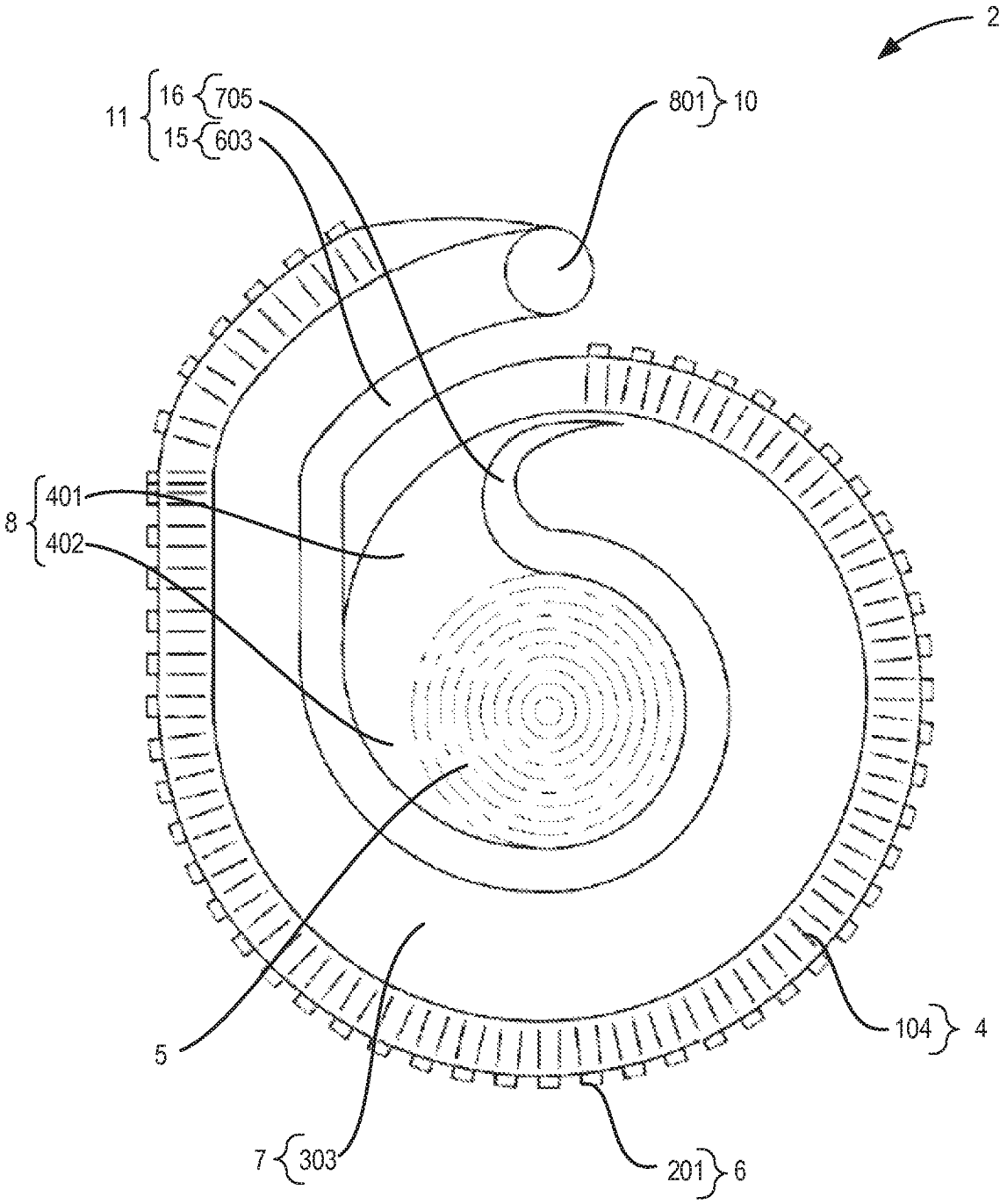
FIG. 7 depicts a view of a wearable wafer turn clip having a deflection channel comprising a reflected deflection channel and having a body ring comprising an overlapped wrap body ring in accordance with various embodiments.

With reference to FIG. 7, the grip ring 4 may comprise an externally spiraled grip ring 104. An externally spiraled grip ring 104 may comprise a grip ring 4 that is radially outward of a body ring 7 comprising an overlapped wrap body ring 303 having an arm portion with both a radial/tangential and a circumferential section. As such, the externally spiraled grip ring 104 may comprise a generally spiraled shape, e.g., comprising an annulus with a variable radius and at least one tangentially and/or radially extending section.

With reference to FIGS. 9, 10, 11, and 12, a grip ring 4 may comprise a grip ring guidance face 105. A grip ring guidance face 105 may comprise a radially and/or tangentially extending distal end of a grip ring 4. The grip ring guidance face 105 may be aligned with the mounting portion 11 of the grip ring 4. As such, the grip ring guidance face 105 may guide the mounting portion 11 into alignment with an article to which the wearable wafer turn clip 2 is intended to be attached. For instance, the grip ring guidance face 105 may comprise an edge aligned orthogonal to the opening plane of the mounting portion 11.

Figure 9:
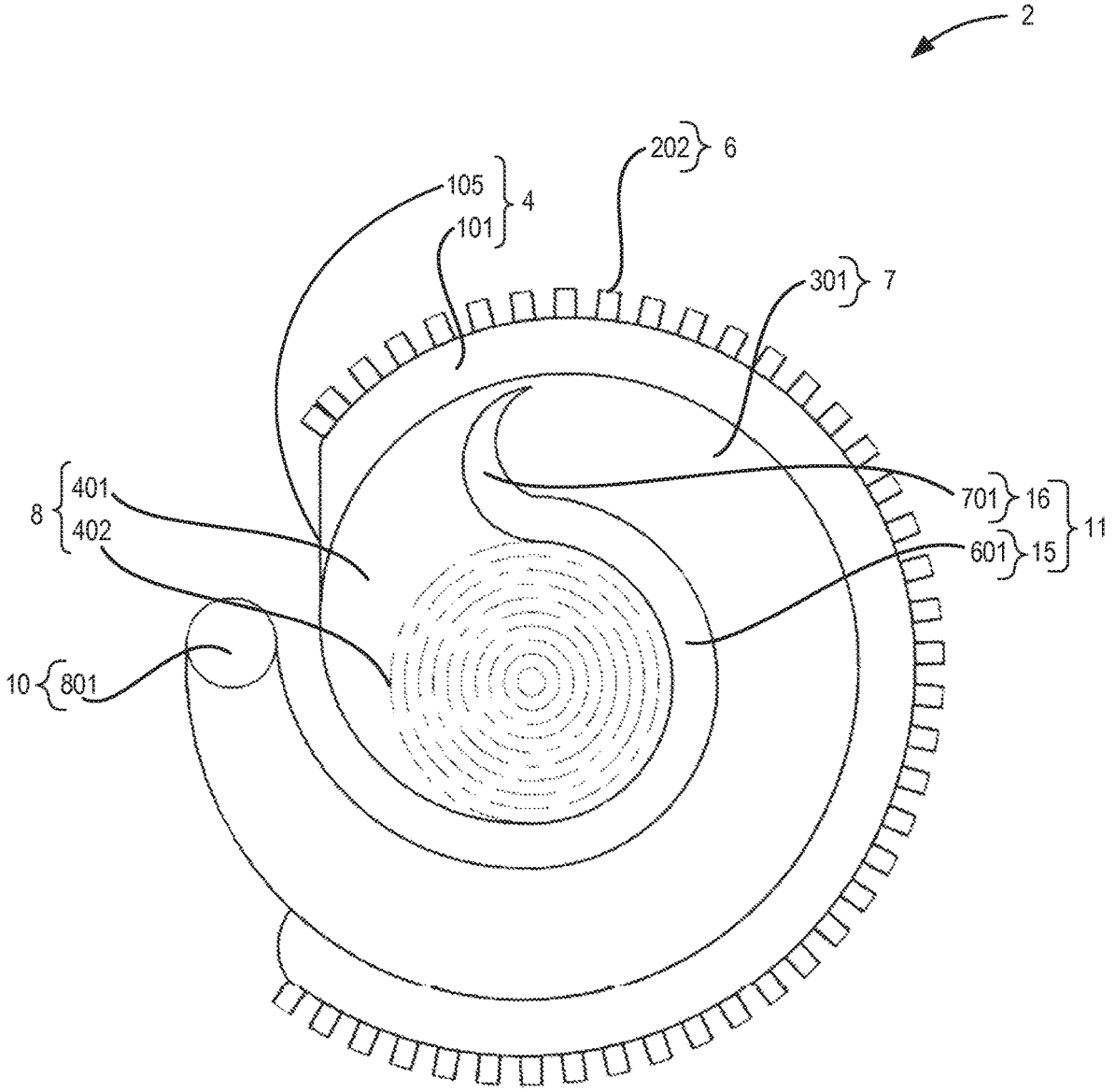
FIG. 9 depicts a view of a wearable wafer turn clip having a segmented manipulation surface, in accordance with various embodiments.
Figure 10:
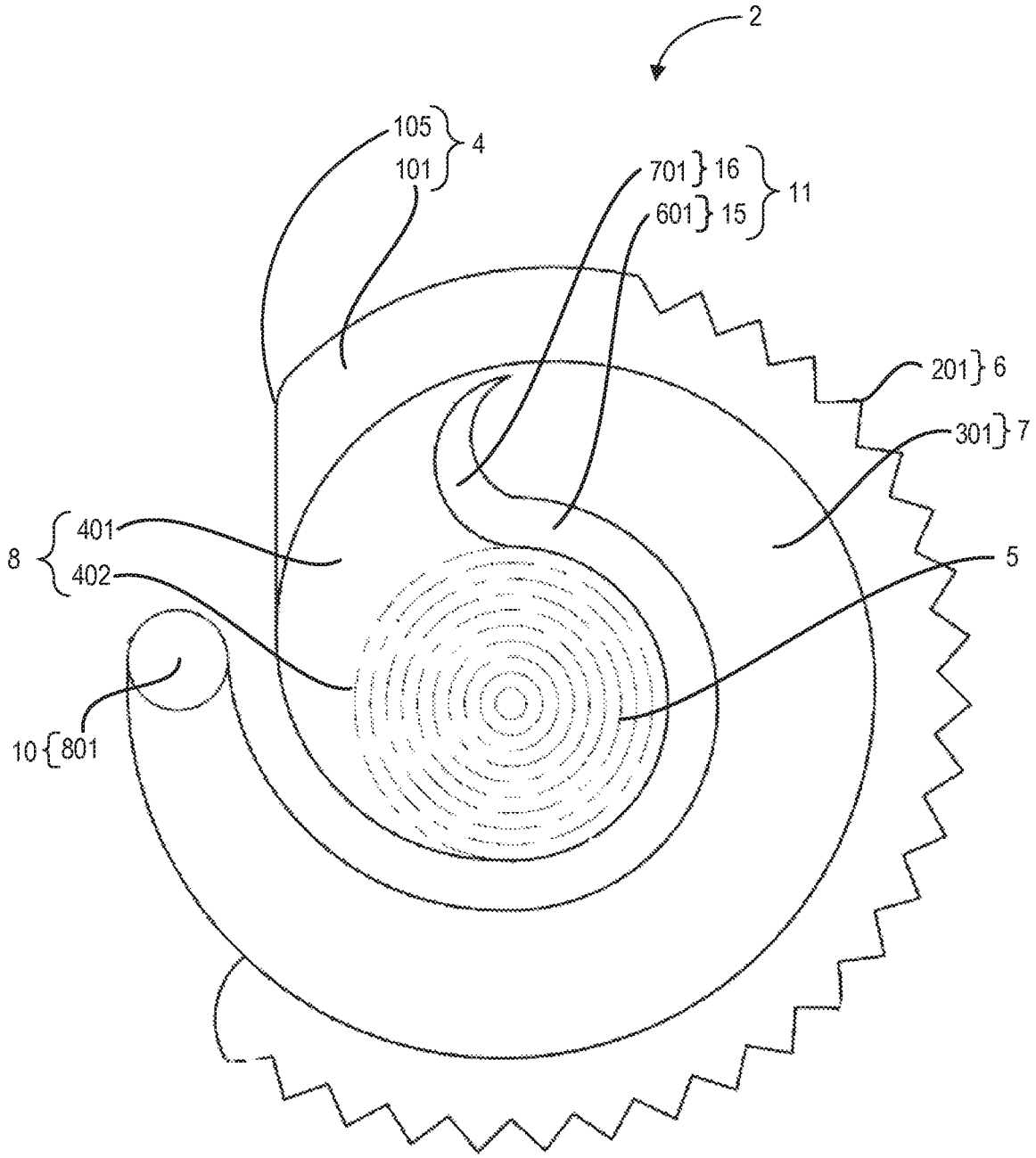
FIG. 10 depicts a view of a wearable wafer turn clip having a grip ring guidance face in accordance with various embodiments.

With renewed reference to FIG. 2, having described various grip rings 4, various manipulation surfaces 6 are discussed in detail. A manipulation surface 6 may comprise a circumferentially outward edge of the grip ring 4 configured to enhance the manual grippability of the wearable wafer turn clip 2. The manipulation surface 6 may comprise an edge having a variety of features. For instance, a wearable wafer turn clip 2 may comprise a manipulation surface 6 that is disposed on the radially outward edge of a grip ring 4. The manipulation surface 6 may comprise a continuous manipulation surface 201 (FIGS. 3A-7, 10-15) or the manipulation surface 6 may comprise a segmented manipulation surface 202 (FIGS. 8-9). In further embodiments, in lieu of or in addition to an actual surface, the manipulation surface 6 may rather comprise an electrical and/or mechanical motive apparatus whereby the wearable wafer turn clip 2 may be gripped, for instance, a motor, a magnet and/or electromagnet, and/or an electrostatic material as desired.

With reference to FIGS. 3A-7, 10-15, a manipulation surface 6 may comprise a continuous manipulation surface 201 comprising a circumferentially outward edge of a grip ring 4 that extends without interruption for the entire arc length of the continuous manipulation surface 201. In contrast, with reference to FIGS. 8-9, a manipulation surface 6 may comprise a segmented manipulation surface 202 may extend with radial discontinuities spaced along the arc length of the segmented manipulation surface 202. For instance, the segmented manipulation surface 202 may comprise a series of raised bosses extending from the edge of the grip ring 4 and facilitating grasping by an operator. In contrast, a continuous manipulation surface 201 may comprise a circumferentially non-discontinuous surface feature of a grip ring 4, for example, roughening, ridging, serrations, scalloping, frictional material, and/or the like.

With returned reference to FIG. 2, having described a body ring 7, various specific body rings 7 are discussed in further detail. A body ring 7 may comprise a single wrap body ring 301 (FIGS. 3A-4, 9-15). Moreover, a body ring 7 may comprise a single wrap with arm body ring 302 (FIG. 5, 6, 8). Furthermore, a body ring 7 may comprise an overlapped wrap body ring 303 (FIG. 7).

With reference now to FIGS. 3A-B, 4, 9-15, a body ring 7 may comprise single wrap body ring 301. A single wrap body ring 301 may comprise a partial annulus having an arc length of 2-pi-radians or less. In other words, the body ring 7 may make no more than a single wrap about a central axis.

Figure 6:
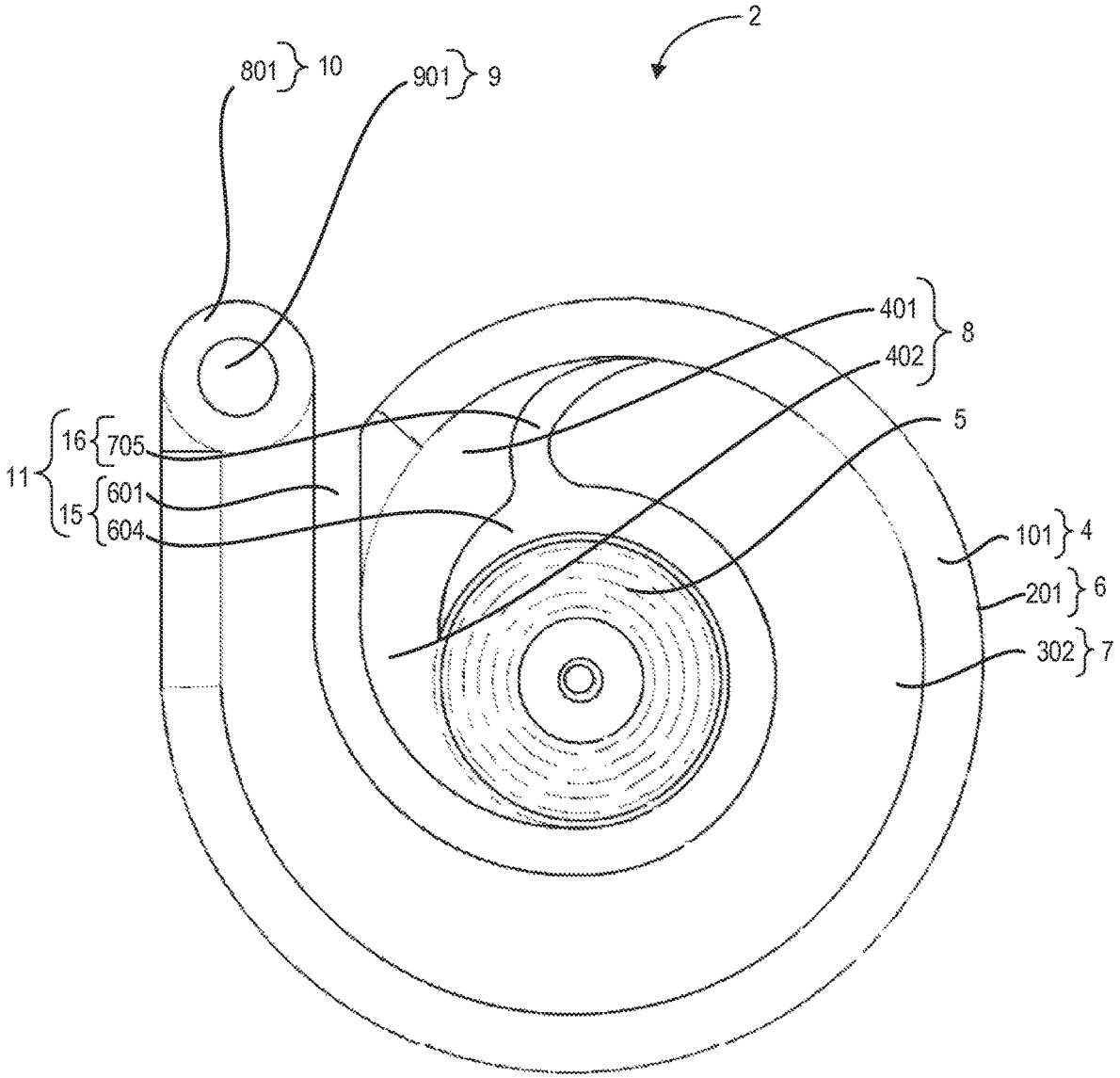
FIG. 6 depicts a view of a wearable wafer turn clip having a mount acceptance channel with an overshoot section in accordance with various embodiments.

With reference to FIGS. 5, 6, and 8, a single wrap with arm body ring 302 may comprise a partial annulus having an arc length of 2-pi-radians or less combined with a linearly extending portion. The linearly extending portion may extend at least one of at least partially radially or radially or at least partially tangentially or tangentially relative to a circle projected about a center point of a wearable wafer turn clip 2.

With reference to FIG. 7, an overlapped wrap body ring 303 may comprise a partial annulus having an arc length of greater than 2-pi-radians. For instance, an overlapped wrap body ring 303 may pass through at least one radial vector of a circle projected about a center point of a wearable wafer turn clip 2 twice. Thus, an overlapped wrap body ring 303 may comprise a spiral, or may comprise concentric partial annuluses joined by a linearly extending portion (as discussed above), or may comprise any applicable shape.

Figure 3A:
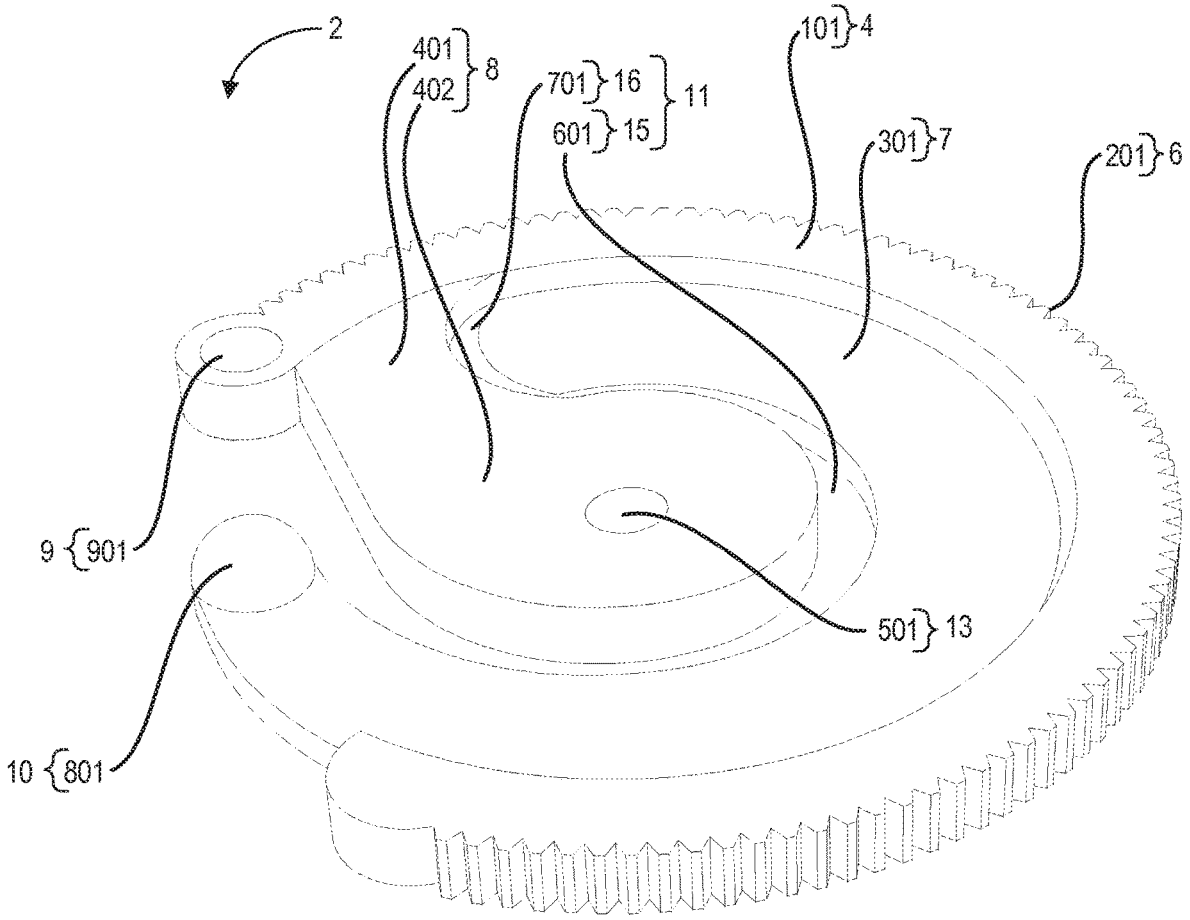
FIGS. 3A-B depict various views of a wearable wafer turn clip having a single wrap channel and a curved wedge according to various embodiments.
Figure 3B:
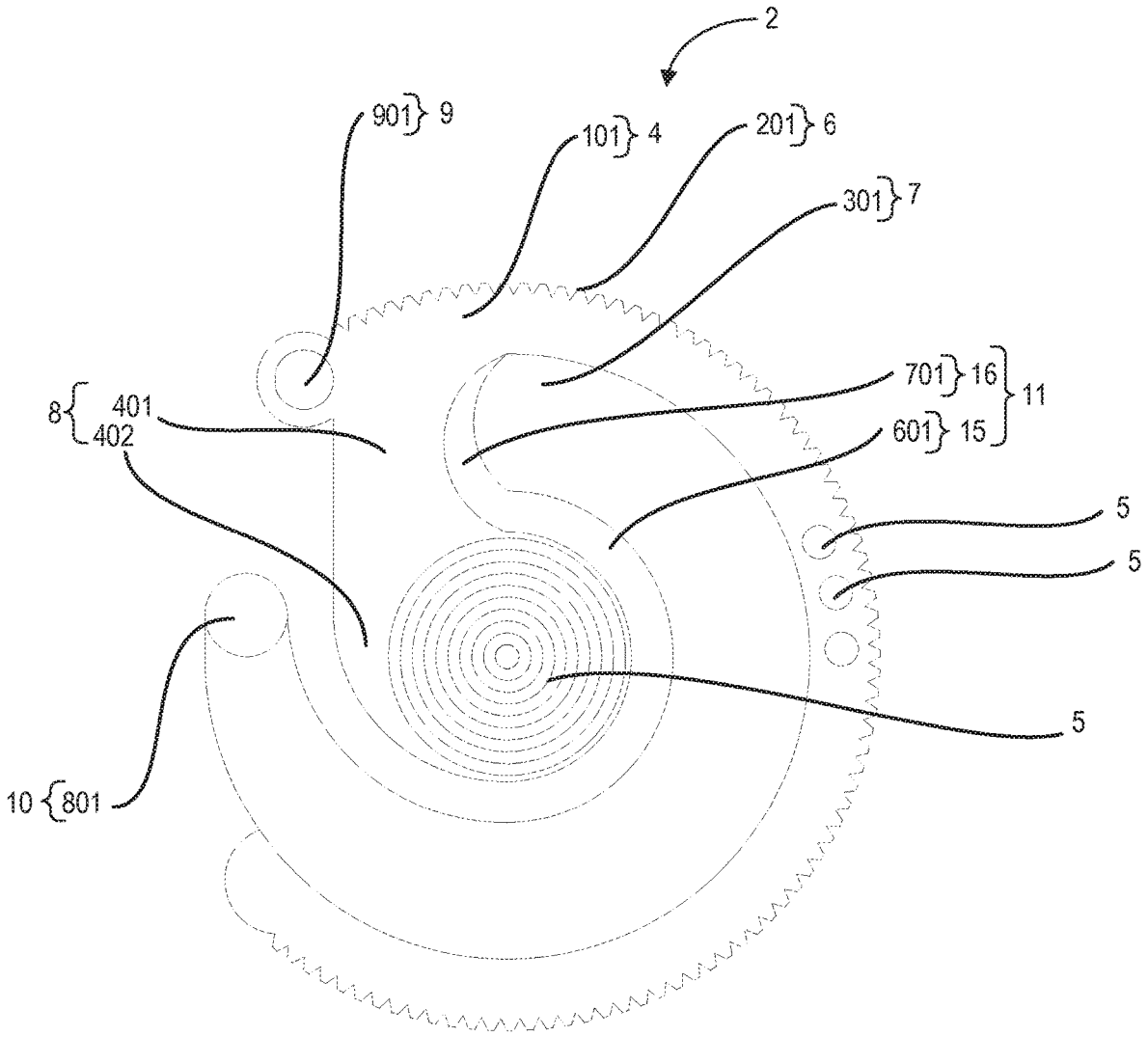
Figure 4:
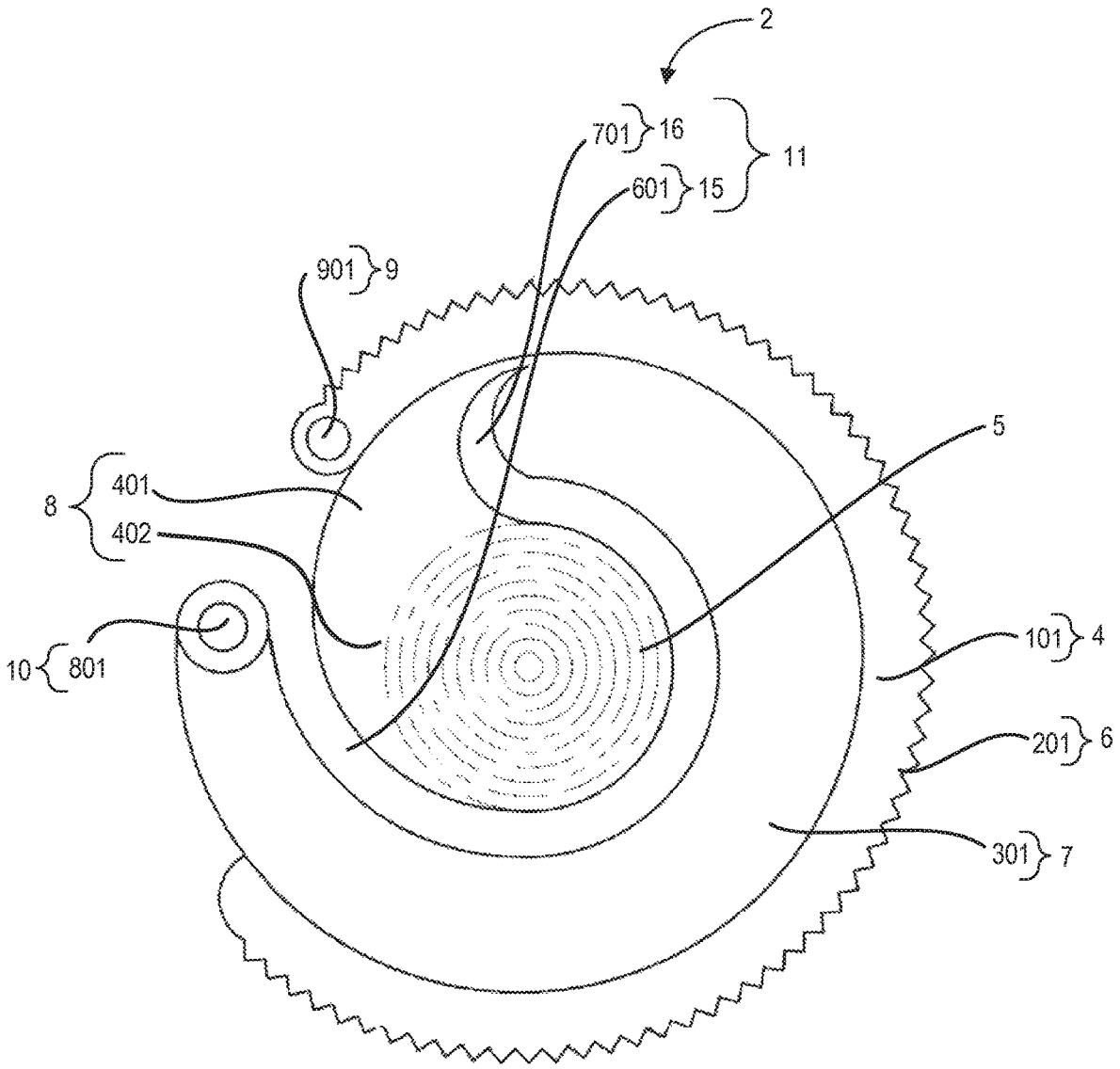
FIG. 4 depicts a view of a wearable wafer turn clip having a single wrap channel and a curved wedge and an arcuate radial arm in accordance with various embodiments.

With renewed reference to FIG. 2, having described various body rings 7 in detail, various inner sections 8 are discussed. With reference to FIGS. 3A-15, an inner section 8 may comprise a radial arm 401 (also called a flange, see ¶0057) and a central boss 402 (also called an inner section center area, see ¶0057). A radial arm 401 may comprise a generally radially extending structure disposed radially inward from the body ring 7 and toward the central axis of the wearable wafer turn clip 2. The radial arm 401 may be the same axial thickness (measured along the central axis of the wearable wafer turn clip 2) as the body ring 7, or may comprise a greater axial thickness (such as to accommodate the disposition of electronics or other features internally therein) or may comprise a lesser axial thickness, or may comprise any thickness as may be desired. The radial arm 401 may further comprise reinforcement features such as internally disposed support bars or spring material and/or the like. In various embodiments, the radial arm 401 extends along an arcuate path (FIGS. 4-15), having a radially inward component, rather than extending linearly radially inward. In further embodiments, the radial arm 401 extends linearly radially inward (FIG. 3A). In various embodiments, the central boss 402 may be integrally formed with the radial arm 401 and disposed at the radially inward end of the radial arm 401. Alternatively, the central boss 402 may be attached to the radial arm 401 and disposed at the radially inward end of the radial arm 401.

Figure 16B:
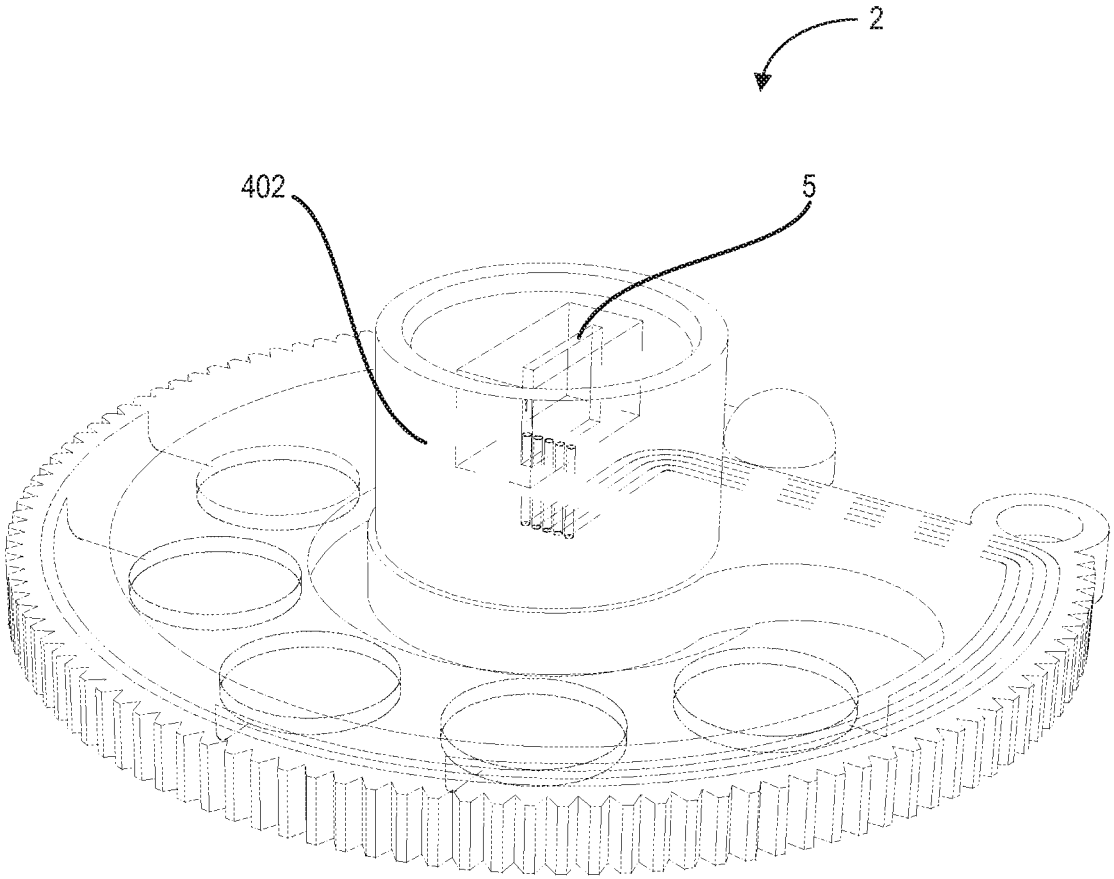

The central boss 402 may be the same axial thickness (measured along the central axis of the wearable wafer turn clip 2) as the body ring 7 and/or the radial arm 401, or may comprise a greater axial thickness (such as to accommodate the disposition of electronics or other features internally therein) or may comprise a lesser axial thickness, or may comprise any thickness as may be desired. The central boss 402 may comprise a non-constant thickness. For instance, the central boss 402 may generally bulge, thickening along a path toward the central axis of the wearable wafer turn clip 2. The central boss 402 may further comprise a cylindrical boss extending axially away from the wearable wafer turn clip 2 and having an aperture disposed therein, such as to receive a device mount 3 (FIGS. 1A-D. For instance the central boss 402 may comprise a device mount receiving member 13 (FIGS. 1D, 2, and 3A), or may have a device mount receiving member 13 attached thereto, or may be proximate to a device mount receiving member 13. With momentary reference to FIGS. 16A-B, the central boss 402 may further comprise enhancement features 5 comprising embedded electronics and/or electrical connectors.

With reference to FIG. 2, a device mount receiving member 13 may be disposed coincident with the central axis of the wearable wafer turn clip 2. The device mount receiving member 13 may comprise a hinge aperture 501 (FIG. 3A), or may comprise an integrally bonded mount 502 (FIG. 17) or may comprise an adhesively bonded or fastener attachable mount.

With reference to FIG. 1D, 3A, 24, 25A, 26, a hinge aperture 501 may comprise an aperture disposed through and defined by the central boss 402 of the inner section 8 of the wearable wafer turn clip 2. The hinge aperture 501 may be configured to receive a fastener 1005 (FIGS. 1D, 24, 25A, 26), such as to permit the attachment of a device mount 3.

Figure 17:
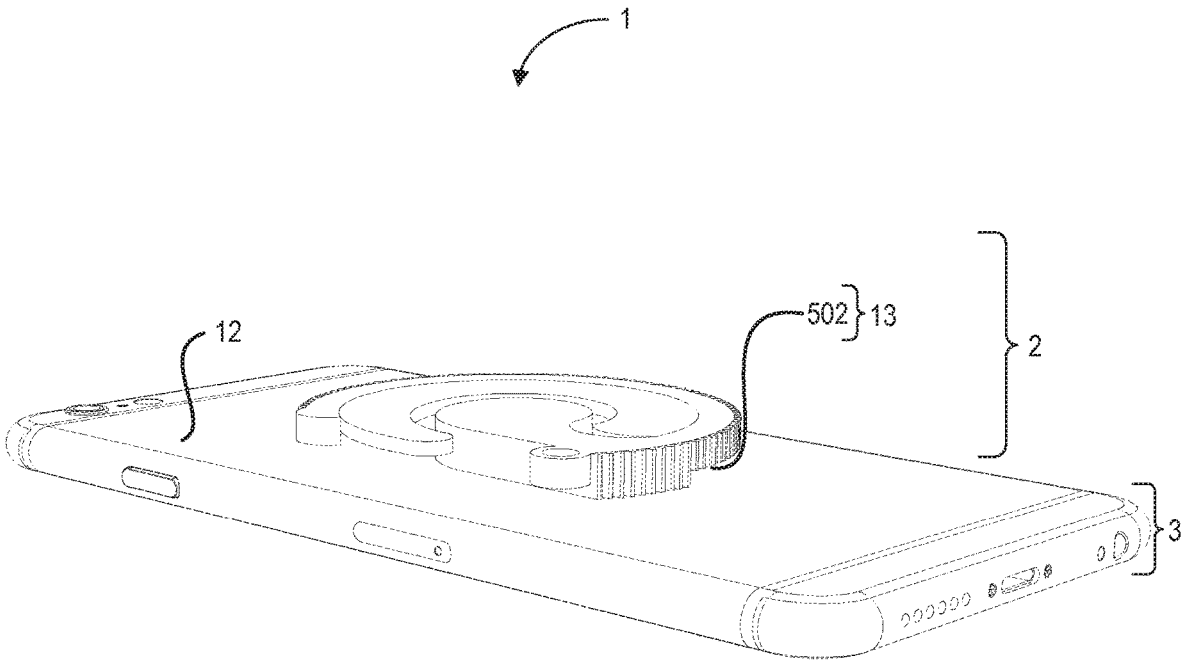
FIG. 17 depicts a view of a device mount comprising an integrated device case, in accordance with various embodiments.

With reference to FIG. 17, an integrally bonded mount 502 may comprise an integral union of the wearable wafer turn clip 2 to a device mount 3. The device mount 3 may be integrally formed with the wearable wafer turn clip 2 and affixed therewith. Alternatively, the integrally bonded mount 502 may comprise an adhesively bonded joint of the device mount 3 to the wearable wafer turn clip 2. For instance, the integrally bonded mount 502 may be an adhesive backed adaptor or sleeve of various sizes and shapes. In further embodiments, the integrally bonded mount 502 may comprise a selectably engagable union of the wearable wafer turn clip 2 to the device mount 3, such as by clips, snaps, interlocks, fasteners, removable adhesive, and/or the like.

With reference to FIG. 2, having discussed various aspects of various device mount receiving members 13 of the wearable wafer turn clip 2, the wearable wafer turn clip 2 may comprise a carrying fixture 9. With reference to FIGS. 3A-6, a carrying fixture 9 may comprise a carrying aperture 901. A carrying aperture 901 may be disposed through and defined by the wearable wafer turn clip 2 proximate to the circumferentially outer edge of the wearable wafer turn clip 2. The carrying aperture 901 may comprise a size and shape configured to receive a carrying device, for instance, an operator's finger, or a karabiner, or a cord, and/or the like.

Figure 13:
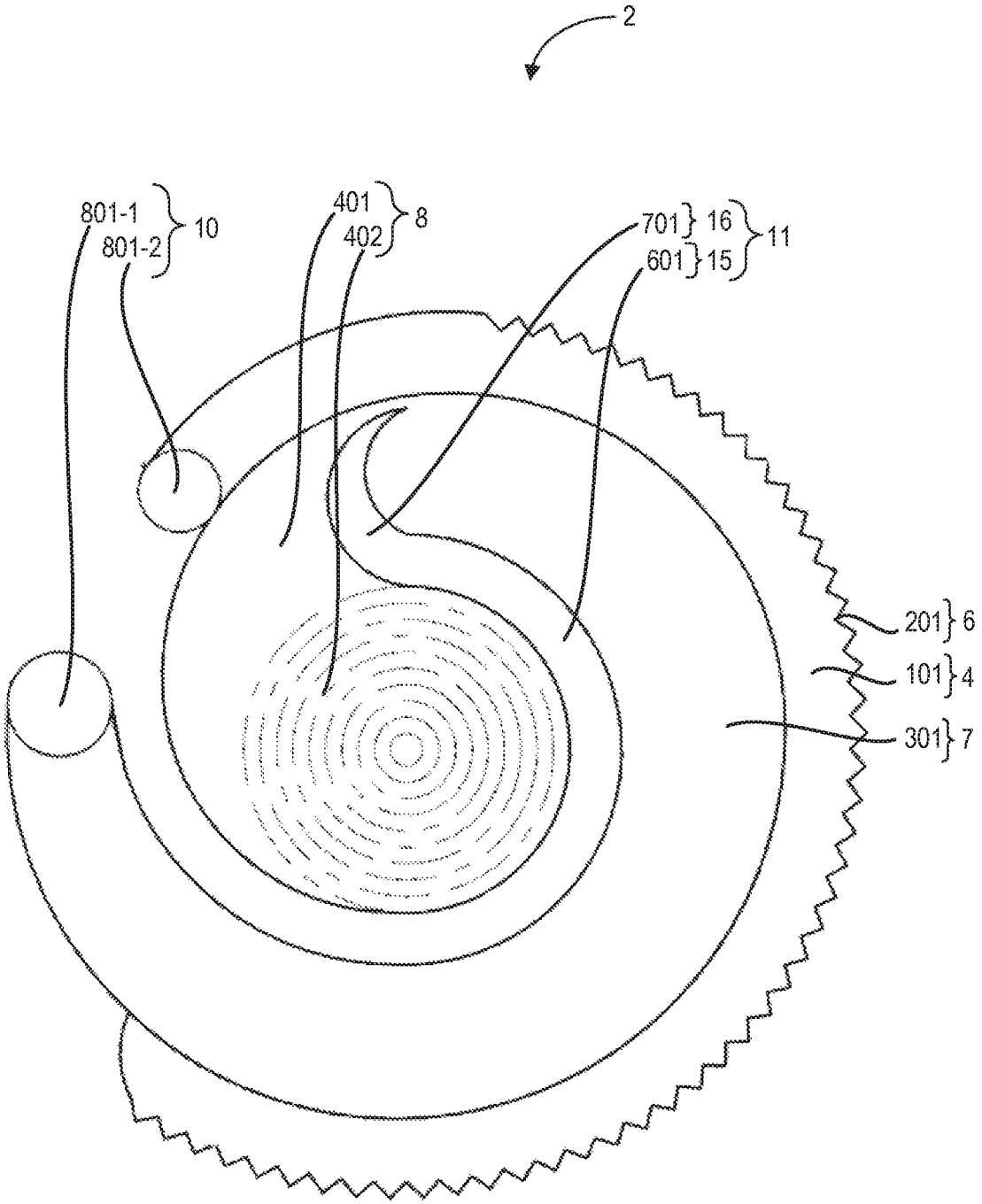
FIG. 13 depicts a view of a wearable wafer turn clip having a tip engagement having multiple raised domes, in accordance with various embodiments.

With reference to FIG. 2, having discussed various aspects of various carrying fixtures 9 of wearable wafer turn clip 2, a tip engagement 10 is disclosed. With reference to FIGS. 3A-13, a tip engagement 10 may comprise a raised dome 801 disposed at the radially and circumferentially outermost end of the body ring 7 and/or grip ring 4. Moreover, in further embodiments, with reference to FIG. 13, a tip engagement 10 may comprise multiple raised domes 801, such as a first raised dome 801-1 and a second raised dome 801-2. For instance, a first raised dome 801-1 may be disposed at one end of a grip ring 4 and/or body ring 7 and a second raised dome 801-2 may be disposed at an opposite end of a grip ring 4 and/or body ring 7. FIG. 13 depicts a first raised dome 801-1 disposed at a distal end of a body ring 7 and a second raised dome 801-2 disposed at a distal end of a grip ring 4, the distal ends being proximate to each other adjacent to a mounting portion 11. While various raised domes 801 are depicted herein as half-hemispheres, any raised shape may be contemplated, such as bosses, trapezoids, triangles, spheroids, cylinders, and/or the like.

In some embodiments, such as depicted in FIGS. 5-6, the tip engagement 10 may be coincident with other features, such as the carrying fixture 9. For instance, a carrying fixture 9, comprising a carrying aperture 901 may be disposed through the center of a tip engagement 10 comprising a raised dome 801.

With reference to FIG. 2, having discussed various aspects of various tip engagements 10 of a wearable wafer turn clip 2, various mounting portions 11 are now discussed in detail. With reference to FIG. 2-15, a mounting portion 11 may comprise a mount acceptance channel 15 and a deflection channel 16 as discussed. Furthermore, the mount acceptance channel 15 and the deflection channel 16 may comprise various configurations. For instance, with reference to FIGS. 3A-B, 4-6, and 8-15, a mount acceptance channel 15 may comprise a single wrap channel 601. A single wrap channel 601 may comprise a circumferential channel defined through the wearable wafer turn clip 2, bounded by the body ring 7 and the inner section 8. In various embodiments, the circumferential channel has a constant radius 4010 (FIG. 12). In further embodiments, the circumferential channel has a variable radius, for instance, spiraling outward or spiraling inward relative to a central axis of the wearable wafer turn clip 2. Moreover, the circumferential channel may have an arc length less than 2-pi-radians. As such, the channel may terminate at a deflection channel 16 (such as at a point of inflection 4005 in FIG. 12). In various embodiments, such as depicted in FIG. 6, the channel may terminate at a juncture of a deflection channel 16 and an overshoot section 604. An overshoot section 604 may comprise a channel extending non-discontinuously from the circumferential channel along an arc extending beyond the deflection channel 16 and with decreasing width.

With reference to FIG. 7, a mount acceptance channel 15 may comprise a segmented wrap channel 603. A segmented wrap channel 603 may comprise a plurality of partial annular channels disposed radially inward of the body ring 7 and circumferentially encircling a portion of the inner section 8. Each partial annulus may extend radially outward of the inner section 8. A segmented wrap channel 603 may comprise one or more partial annular channel that is radially inward of a body ring 7 and a linear channel portion corresponding in path to an arm portion of an overlapped wrap body ring 303. As such, the channel may have at least one tangentially and/or radially extending section. The segmented wrap channel 603 may thus comprise at least two partial annuluses having a combined arc length of greater than 2-pi-radians. For instance, a segmented wrap channel 603 may pass through at least one radial vector of a circle projected about a center point of a wearable wafer turn clip 2 twice. A segmented wrap channel 603 may comprise partial annuluses joined by a linearly extending portion (as discussed above), or may comprise any applicable shape. In various embodiments, the partial annuluses are concentric.

With renewed reference to FIG. 2, having discussed various features of the mount acceptance channel 15, a mounting portion 11 of a wearable wafer turn clip 2 my further comprise a deflection channel 16 comprising various aspects. For instance, with reference to FIGS. 3A-4, 9-13, and 15, a deflection channel 16 may comprise a curved wedge 701. Moreover, with specific reference to FIG. 11, deflection channels 16 may comprise a plurality of curved wedges 701 disposed evenly along at least a portion of the arc length of the mount acceptance channel 15. For instance, a deflection channel 16 may comprise a first curved wedge 701-1, a second curved wedge 701-2, a third curved wedge 701-3, a fourth curved wedge 701-4, and a fifth curved wedge 701-5.

With reference to FIGS. 3A-B, 4, 9-13, and 15, a curved wedge 701 may comprise an arcuate channel extending generally radially outward from the central axis of the wearable wafer turn clip 2 (and/or the mount acceptance channel) and with decreasing width (e.g., "wedge" shaped).

Figure 14:
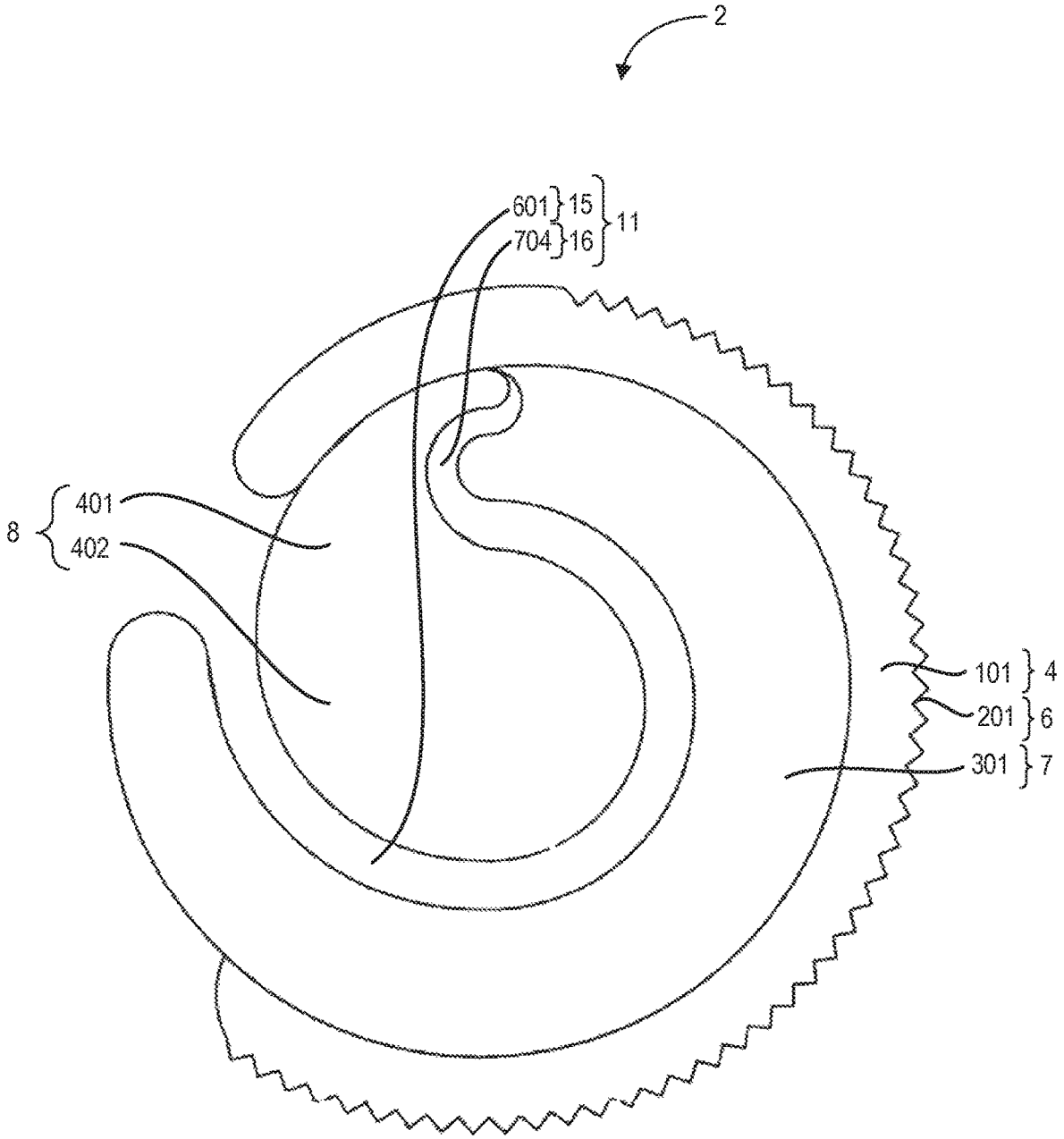
FIG. 14 depicts a view of a wearable wafer turn clip having a deflection channel comprising a serpentine wedge, in accordance with various embodiments.
Figure 15:
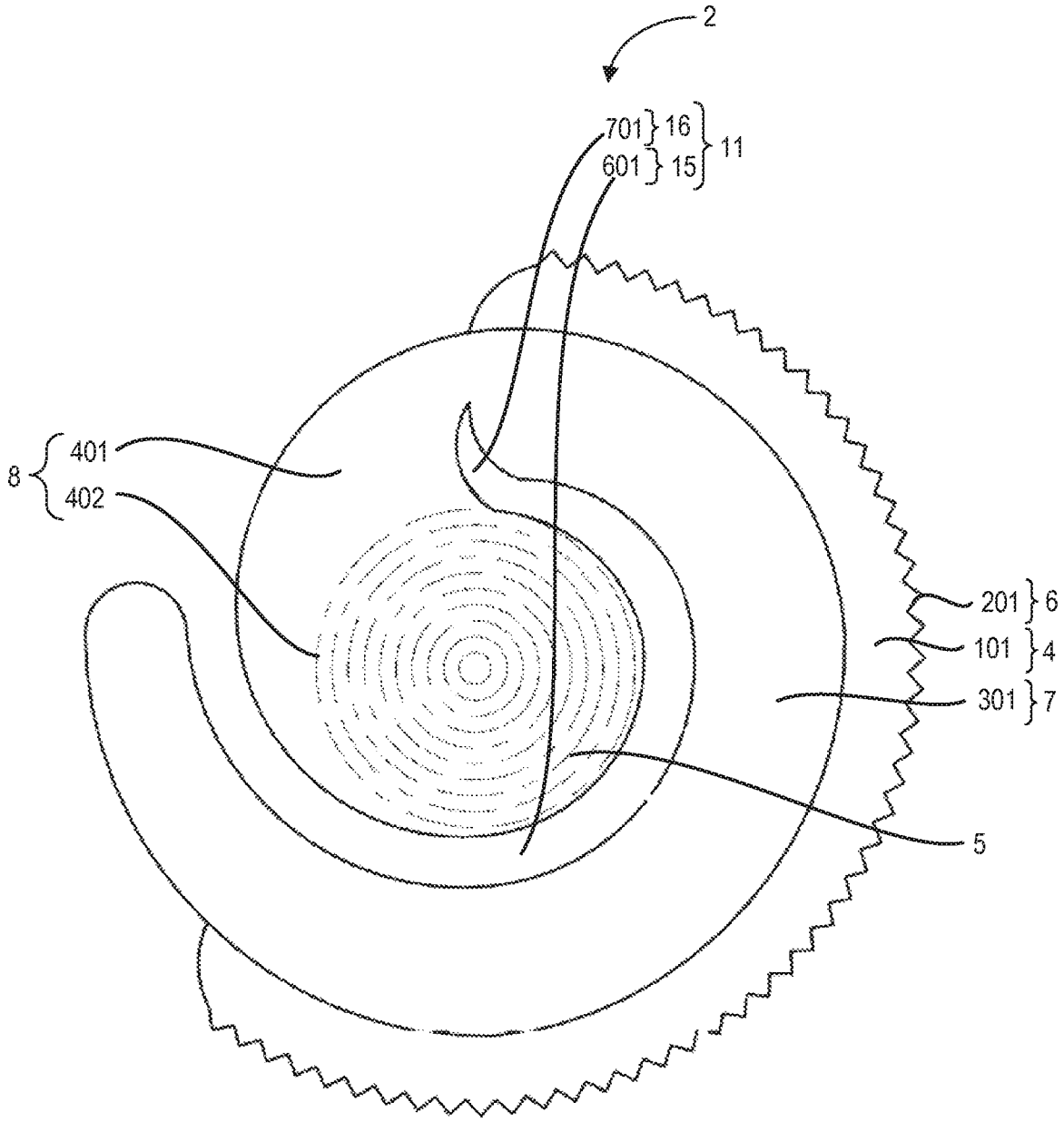
FIG. 15 depicts a view of a wearable wafer turn clip having an inner section comprising an arcuate radial arm in accordance with various embodiments.

With reference to FIG. 14, a deflection channel 16 may comprise a serpentine wedge 704. A serpentine wedge 704 may comprise an arcuate channel extending generally radially outward from the central axis of the wearable wafer turn clip 2 and with decreasing width, the arcuate channel further comprising at least two points of inflection.

With reference to FIGS. 5-8, a deflection channel 16 may comprise a reflected deflection channel 705. A reflected deflection channel 705 may comprise an arcuate channel extending generally radially outward from the central axis of the wearable wafer turn clip 2 and with decreasing width. The arcuate channel may further extend generally circumferentially relative to the central axis of the wearable wafer turn clip 2 in the opposite direction of the mount acceptance channel 15. In this manner, the reflected deflection channel 705 may be said to be "reflected."

With reference to FIGS. 2, 3B-8, 10-11, 15, and 16A-B, a wearable wafer turn clip 2 may comprise enhancement features 5, for instance, a wearable wafer turn clip 2 may comprise embedded sensors, electronics, wearable computers or computing devices, cameras, antennas, electromagnetics, lights, magnets, and/or any other embedded device or material as may be desired. Moreover, enhancement features 5 may be disposed in various portions of a wearable wafer turn clip 2. For instance, enhancement features 5 may be disposed in and/or spaced along a grip ring 4, a body ring 7, and/or an inner section 8. For instance, an antenna may be disposed along a radial arm 401 and/or grip ring 4 and/or body ring 7, and electronics may be disposed in a central boss 402. Moreover, various lights and/or sensors may be disposed along a grip ring 4 and/or body ring 7, or may be disposed in an inner section 8. Moreover, various enhancement features 5 may be in electronic communication with at least one device mount 3 having its own enhancement features 5 (see FIG. 23) and/or a device retained in/by the device mount 3.

Now, having described various aspects of various wearable wafer turn clips 2 of a wearable wafer turn clip mounting system 1 attention is directed to FIGS. 17-26 and various device mounts 3 of a wearable wafer turn clip mounting system 1 are further discussed below. A device mount 3 (as may also a wearable wafer turn clip 2) may comprise an apparatus configured to retain items such as electronics, tools, electronic funds transfer devices, network devices, digital video devices, wearable sensors, proximity sensors, smart phones, receivers, transmitters, computers, smart phones, electronic keys, equipment for sport, hunting, and/or work, and/or the like. For example, a device mount 3 may retain retail beacons, motion sensors, safety, and/or health sensors such as for children, invalids, and athletes, holsters, sheaths, lights such as task, safety and/or night lights, energy collection devices, and the like. With reference to FIG. 17, a device mount 3 may comprise an integrated device case 12. An integrated device case 12 may comprise a case shaped corresponding to a device desired to be mounted by the wearable wafer turn clip mounting system 1. For instance, the integrated device case 12 may comprise a smartphone case as depicted in FIG. 17. As such, an integrated device case 12 may be integrally joined and/or bonded by adhesion to an integrally bonded mount 502 of a device mount receiving member 13 of a wearable wafer turn clip 2.

Figure 18:
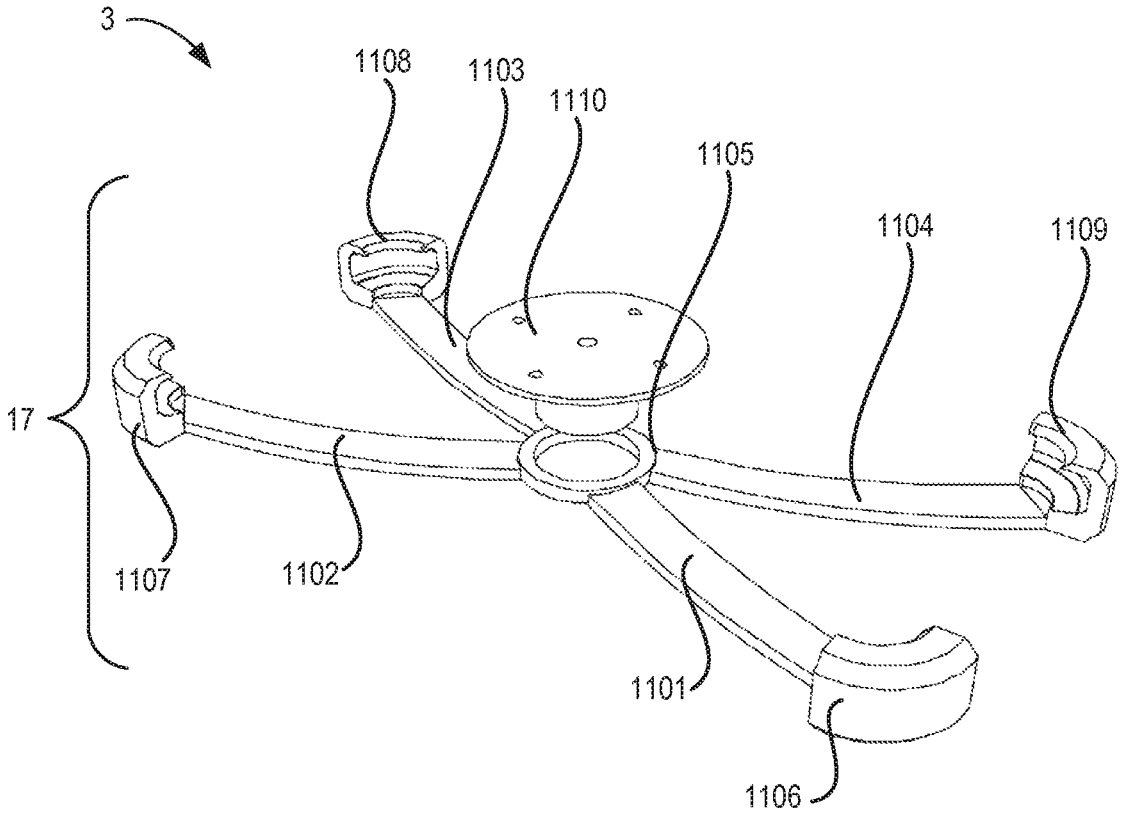
FIG. 18 depicts a view of a device mount comprising a pivotable device framework, in accordance with various embodiments.

With reference to FIG. 18, a device mount 3 may comprise a pivotable device framework 17. For instance, a pivotable device framework 17 may comprise a frame structure configured to selectably receive a device and configured to mount the device in rotatable connection to the wearable wafer turn clip 2. Thus, the pivotable device framework 17 may comprise a first arm 1101, a second arm 1102, a third arm 1103, and a fourth arm 1104. Each arm 1101, 1102, 1103, and 1104 may extend in a different direction outwardly from an arm junction annulus 1105. For instance, an arm junction annulus 1105 may comprise a ring of material centrally disposed among and connected to each arm 1101, 1102, 1103, and 1104. In various embodiments, each arm 1101, 1102, 1103, and 1104 extends outwardly from the arm junction annulus 1105, being spaced an equal arc length around the arm junction annulus 1105 and extending outwardly therefrom. A corner may be disposed at the outermost end of each arm 1101, 1102, 1103, 1104 configured to engage with at least one of a corner and/or side of a device to be retained. For instance, the first arm 1101 may comprise a first corner 1106, the second arm 1102 may comprise a second corner 1107, the third arm 1103 may comprise a third corner 1108, and the fourth arm 1104 may comprise a fourth corner 1109.

The arm junction annulus 1105 may receive an interface boss 1110 disposed through a central aperture of the arm junction annulus 1105 and configured to be received into a wearable wafer turn clip 2. In this manner, the interface boss 1110 may be retained in rotatable mechanical communication with the wearable wafer turn clip 2. Correspondingly, the pivotable device framework 17 may rotate, permitting the retained device to be variously oriented, such as with respect to an operator's body.

Figure 19:
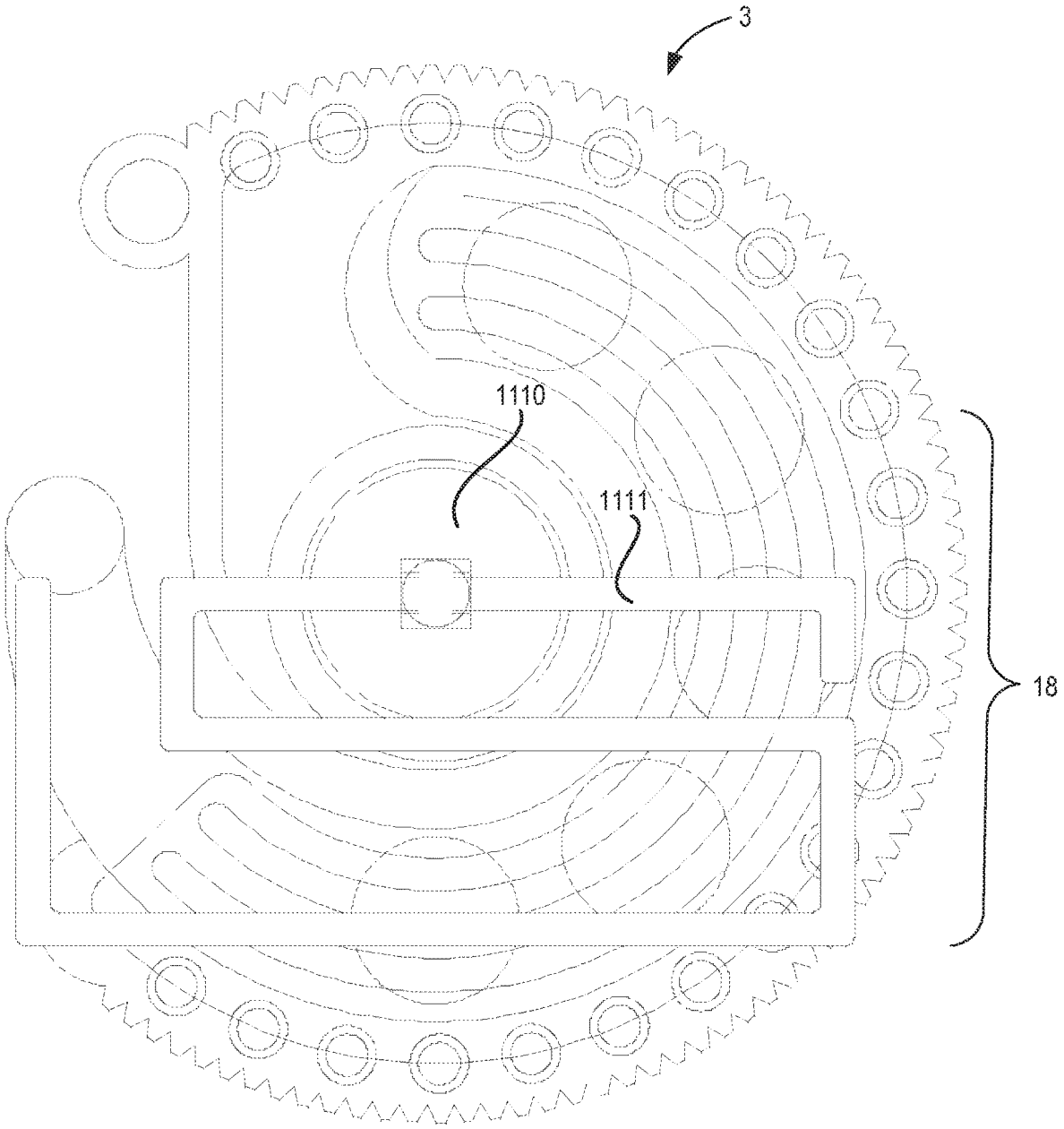
FIG. 19 depicts a view of a device mount comprising a coupled pin adaptor, in accordance with various embodiments.

With reference to FIG. 19, a device mount 3 may comprise a coupled pin adaptor 18. A coupled pin adaptor 18 may comprise a pin coupled to a boss and configured to be received by a wearable wafer turn clip 2. The boss may be retained in rotatable communication with the wearable wafer turn clip 2, and the wearable wafer turn clip 2 may be retained in mechanical communication to the boss. For instance, an interface boss 1110 may be configured to be received by a wearable wafer turn clip 2. The interface boss 1110 may connect to a wearable wafer turn clip pin 1111. The wearable wafer turn clip pin 1111 may comprise an S-shaped pin disposed through a portion of the interface boss 1110 and arranged to receive a device, such as a cloth strap. For instance, a cloth strap may be interleaved among the turns of the S-shaped pin (wearable wafer turn clip pin 1111).

Figure 20:
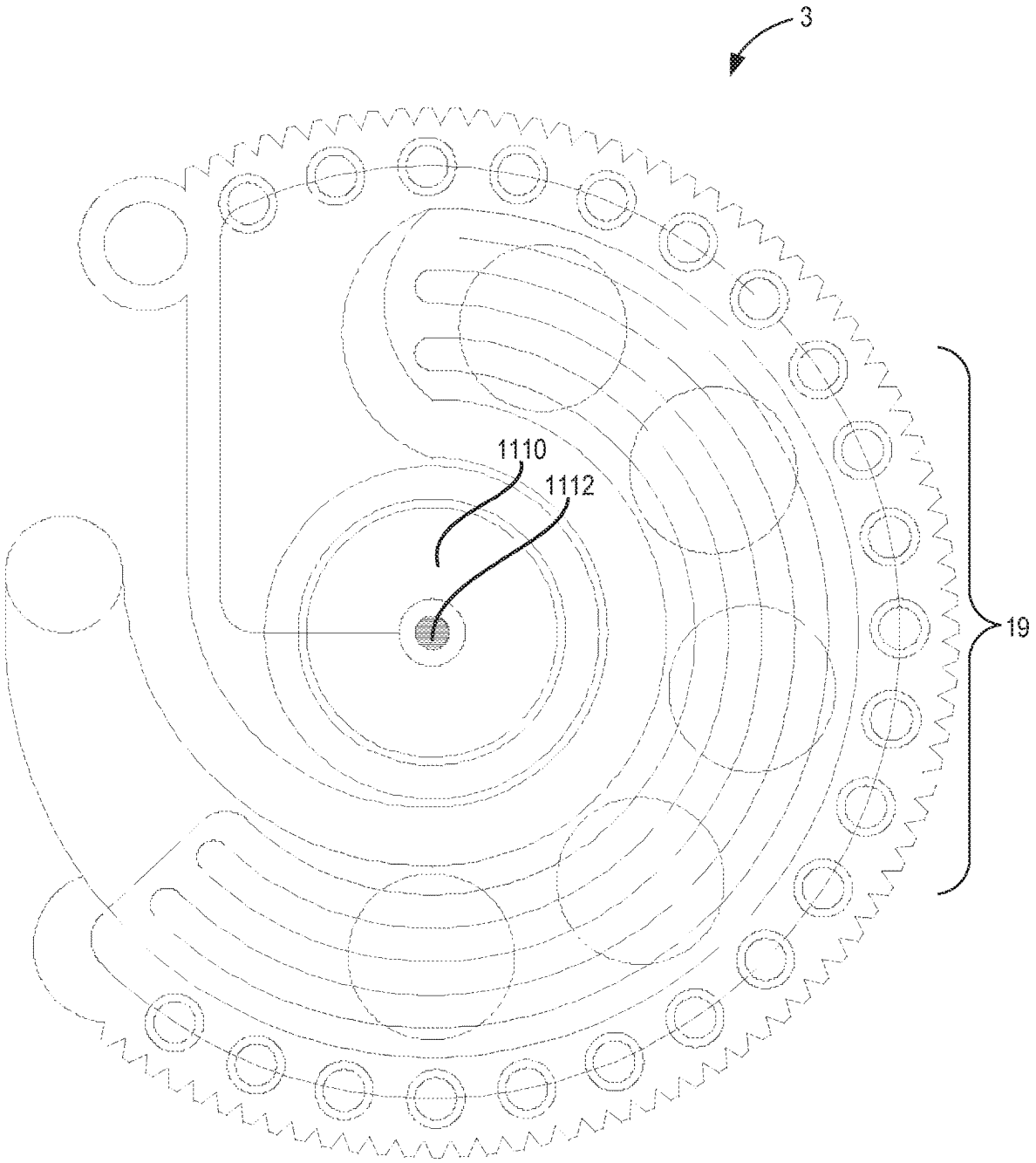
FIG. 20 depicts a view of a device mount comprising a coupled thread adaptor, in accordance with various embodiments.

With reference to FIG. 20, a device mount 3 may comprise a coupled thread adaptor 19. A coupled thread adaptor 19 may comprise an interface boss 1110 as discussed herein. The coupled thread adaptor 19 may further comprise a threaded post 1112. The threaded post 1112 may comprise a pin extending axially outward from the interface boss 1110 along a central axis of the interface boss 1110 and with threads disposed thereon. The threaded post 1112 may receive a device, such as a camera, wearable computer, sensor, and/or the like, having corresponding threads.

Figure 21:
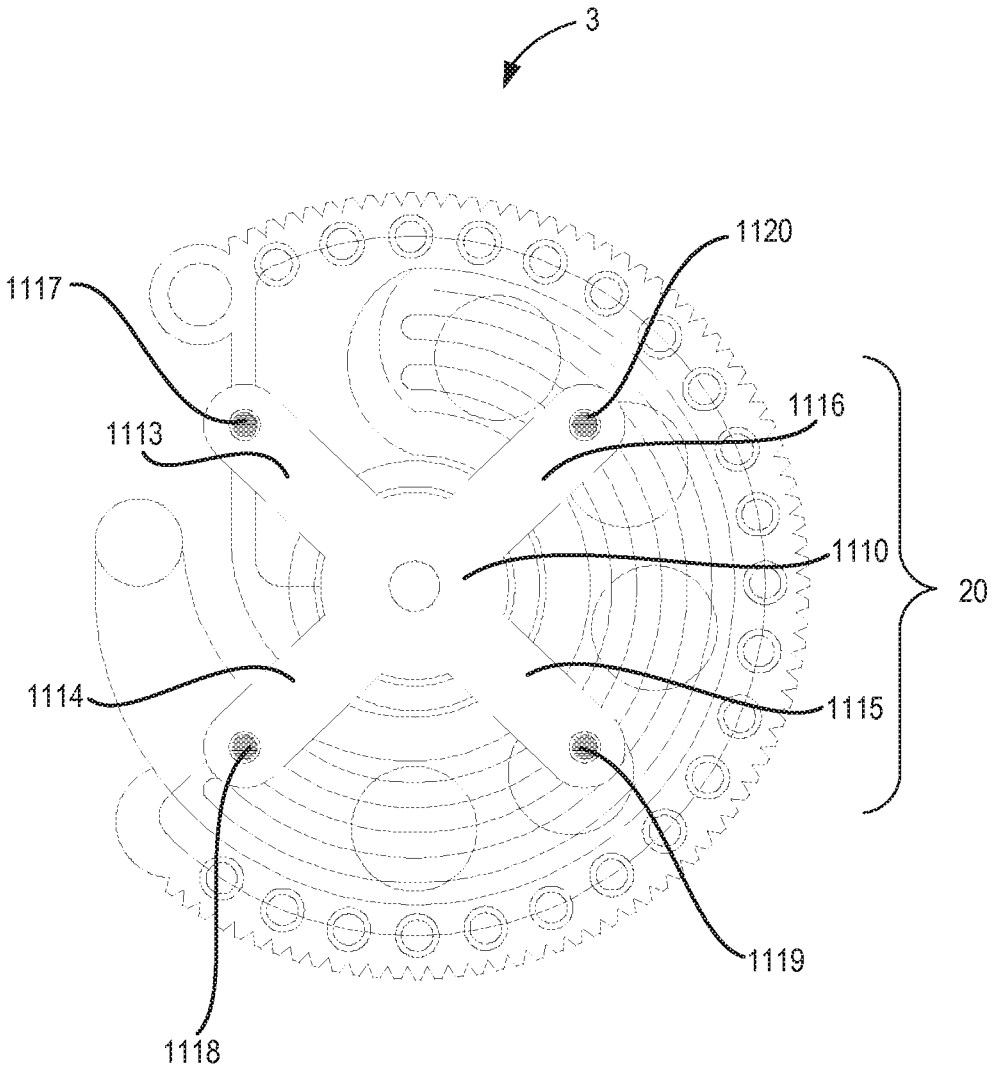
FIG. 21 depicts a view of a device mount comprising a coupled plug adaptor, in accordance with various embodiments.

With reference to FIG. 21, a device mount 3 may comprise a coupled plug adaptor 20. A coupled plug adaptor 20 may comprise an interface boss 1110 as discussed herein. The coupled plug adaptor 20 may further comprise a first plug arm 1113, a second plug arm 1114, a third plug arm 1115, and a fourth plug arm 1116. Each plug arm 1113, 1114, 1115, and 1116 may extend in a different direction outwardly from the interface boss 1110. For instance, each plug arm 1113, 1114, 1115, and 1116, may be spaced an equal arc length around the interface boss 1110 and each may comprise a pin extending outwardly therefrom and configured to be received by a device to be mounted thereto. For instance, the first plug arm 1113, may comprise a first plug pin 1117, the second plug arm 1114 may comprise a second plug pin 1118, the third plug arm 1115 may comprise a third plug pin 1119, and the fourth plug arm 1116 may comprise a fourth plug pin 1120.

Figure 22:
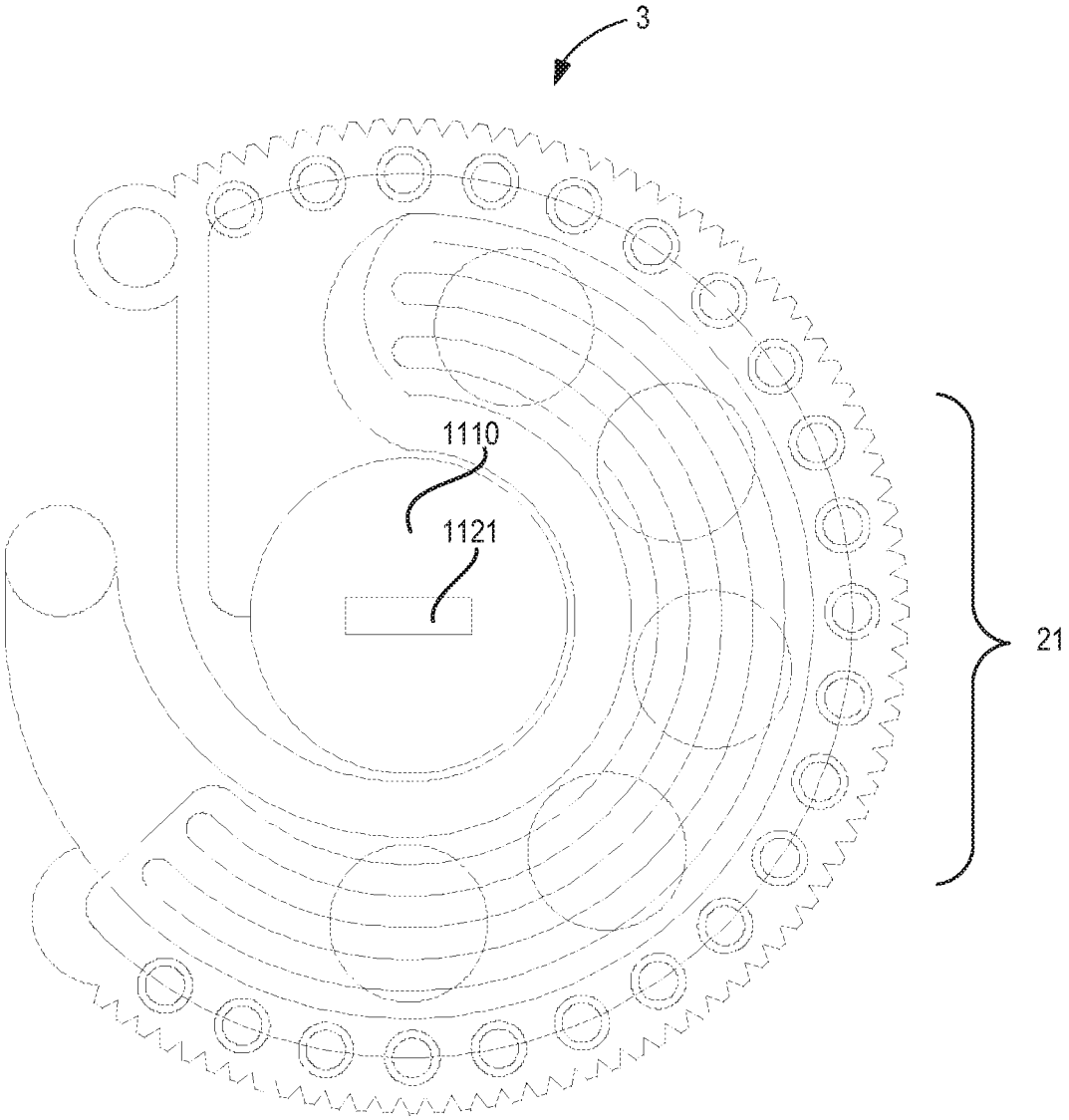
FIG. 22 depicts a view of a device mount comprising a coupled slot adaptor, in accordance with various embodiments.

With reference to FIG. 22, a device mount 3 may comprise a coupled slot adaptor 21. For instance, a coupled slot adaptor 21 may comprise an interface boss 1110 as discussed herein. The coupled slot adaptor 21 may further comprise a coupling slot 1121. A coupling slot 1121 may comprise a slot cut into the interface boss 1110. The slot may be configured to receive a device desired to be mounted thereto. Moreover, the coupling slot 1121 may comprise electrical contacts, for instance, the coupling slot 1121 may comprise a USB connector.

Figure 24:
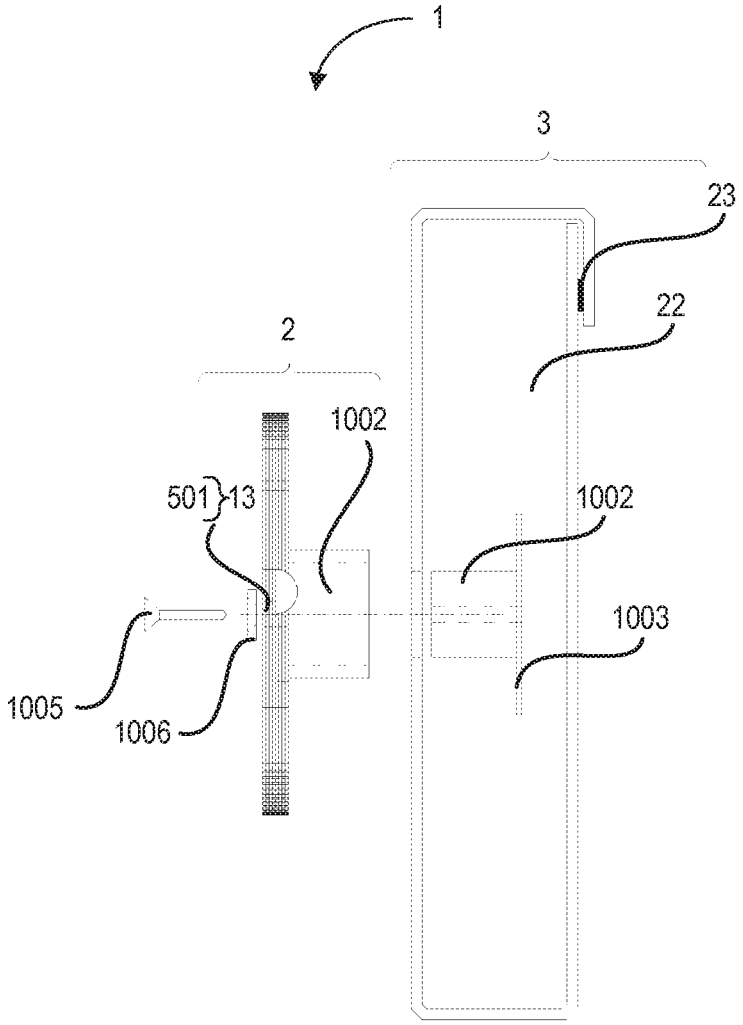
FIG. 24 depicts a view of a device mount comprising a pivotable device holster.

With reference to FIG. 24, a device mount 3 may comprise a device holster 22. For instance, a device holster 22 may comprise a selectably sealable enclosure for the enclosing of a device. The device holster 22 may comprise a closure feature 23. A closure feature 23 may comprise a hook and loop fastener strip, or snaps, or a zipper, or any other selectably closable fastener as desired.

Figure 25A:
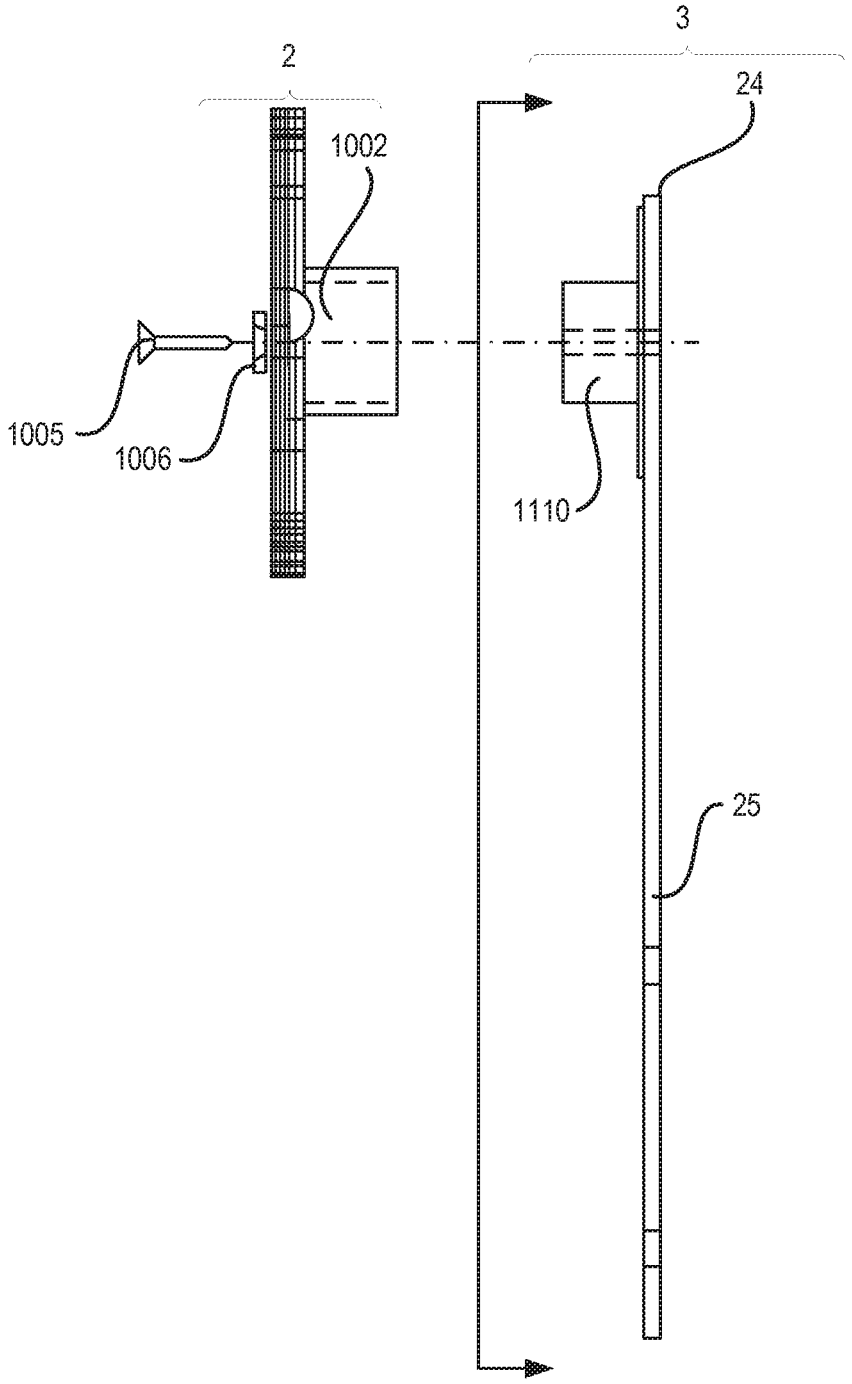
FIGS. 25A-B depict views of a device mount comprising a drop strap adaptor.
Figure 25B:
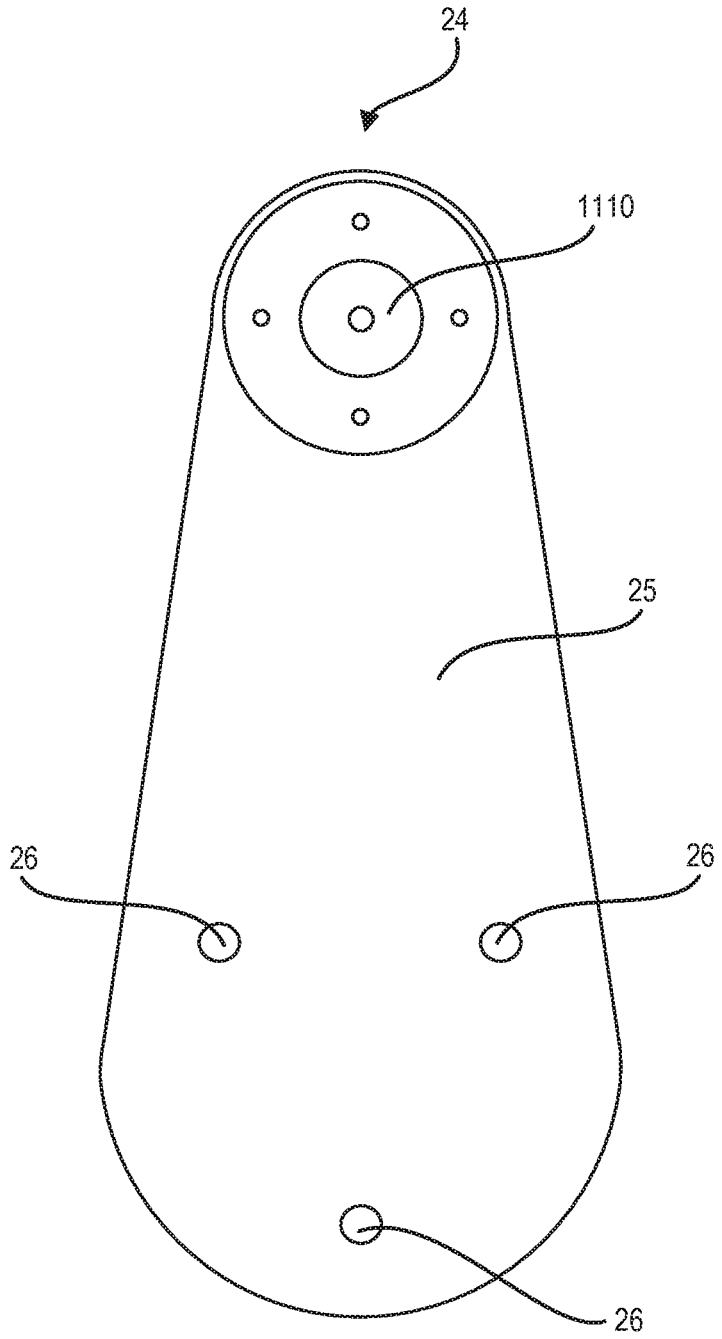

With reference to FIG. 25A-B, a device mount 3 may comprise a drop strap adaptor 24. For instance, a drop strap adaptor 24 may comprise a drop flange 25. A drop flange 25 may comprise a flange extending radially outward from central axis of the interface boss 1110, such as to provide an extension of the mounting surface of the device mount 3. The drop flange 25 may have mounting holes 26, such as for the attachment of an adaptor, or any other device as desired.

Figure 26:
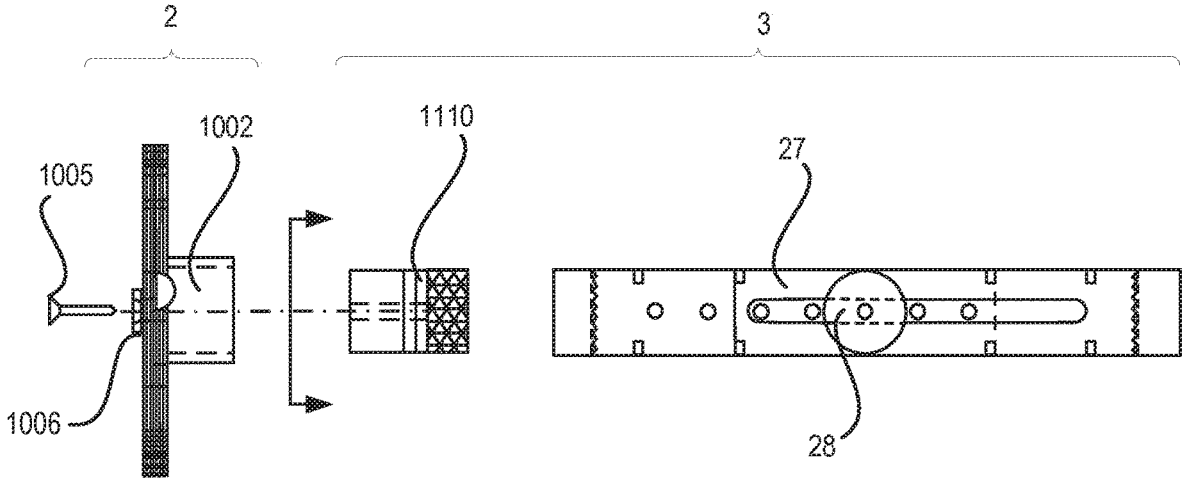
FIG. 26 depicts a view of a device mount comprising a slide clamp adaptor.

With reference to FIG. 26, a device mount 3 may comprise a slide clamp adaptor 27. A slide clamp adaptor 27 may comprise a flange extending axially outward from the central axis of the interface boss 1110. The slide clamp adaptor 27 may comprise a slide channel 28 disposed through the slide clamp adaptor 27 and configured to receive a device in slidable communication.

Figure 27:
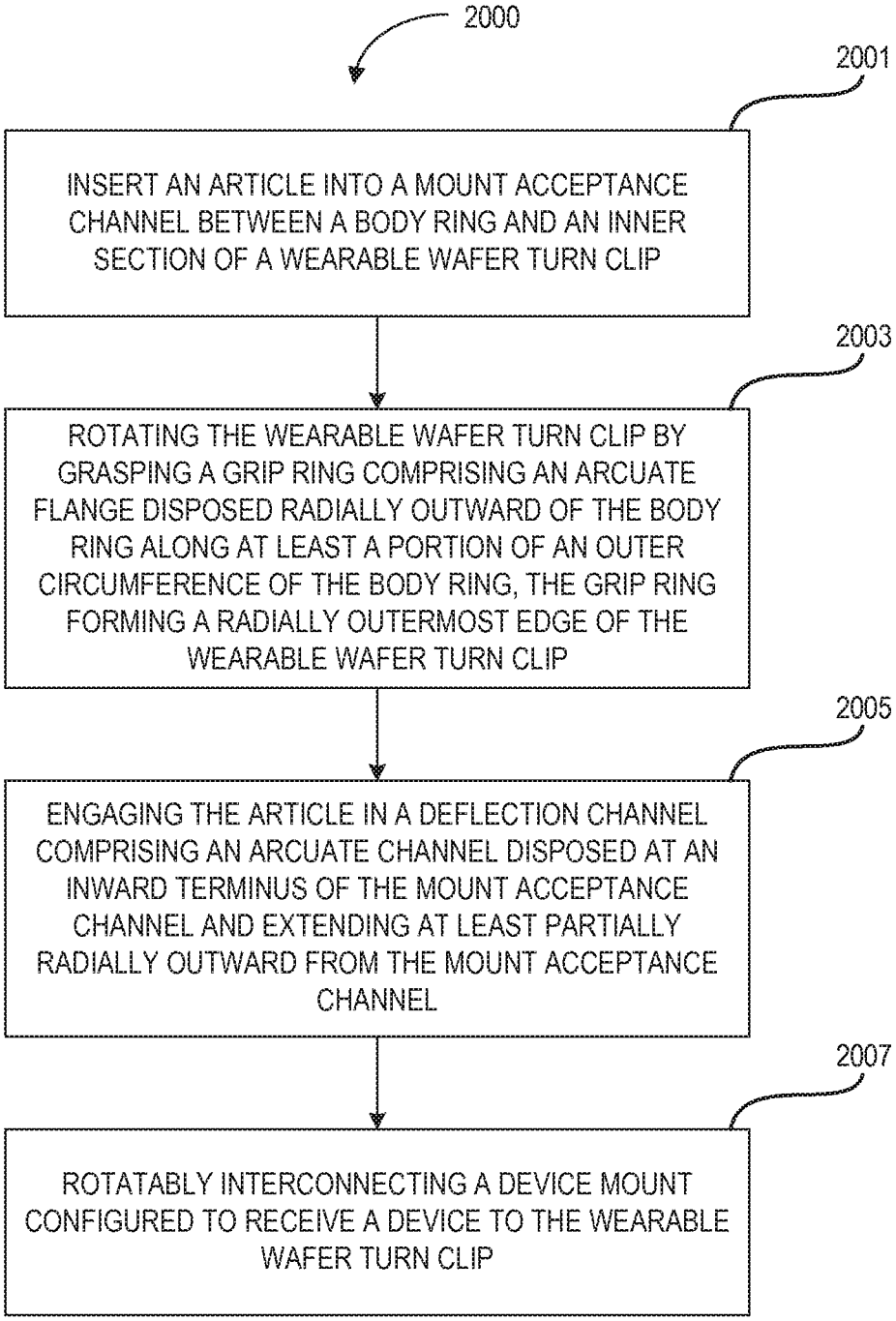
FIG. 27 depicts a method of donning a wearable wafer turn clip, according to various embodiments.

With reference to FIGS. 1-26 and particular reference to FIG. 27, a method of donning a wearable wafer turn clip 2000 is disclosed. The method 2000 may include inserting an article into a mount acceptance channel 15 between a body ring 7 and an inner section 8 of a wearable wafer turn clip 2 (Step 2001). The method may further include rotating the wearable wafer turn clip 2 by grasping a grip ring 4 comprising an arcuate flange disposed radially outward of the body ring 7 along at least a portion of an outer circumference of the body ring 7, the grip ring 4 forming a radially outermost edge of the wearable wafer turn clip 2 (Step 2003). Finally, the method may include engaging the article in a deflection channel 16 comprising an arcuate channel disposed at an inward terminus of the mount acceptance channel 15 and extending at least partially radially outward from the mount acceptance channel 15 (Step 2005). In various embodiments, the method includes inserting a device into a device mount 3 wherein the wearable wafer turn clip 2 may be rotatably interconnected to a device mount 3 configured to receive a device, and wherein the device may, for example, comprise a smart phone (Step 2007). An operator may, while rotating the wearable wafer turn clip 2, gradually apply a force and/or gradually increase the applied force through a range of natural arm and wrist angles, resulting in attachment (in contrast to a traditional compressive clip). Moreover, the generally rotational motion of the wearable wafer turn clip 2 during donning as well as the generally low profile of the wearable wafer turn clip 2 facilitates use with touch sensitive devices without inadvertent activation of touch sensitive features.

Now, having described various components of various exemplary wearable wafer turn clip mounting systems, the wearable wafer turn clip mounting system 1 may be manufactured from various materials. In one exemplary embodiment, the wearable wafer turn clip mounting system 1 may comprise plastic. Alternatively, the wearable wafer turn clip mounting system 1 may comprise metal, such as titanium, steel, or stainless steel, though it may alternatively comprise numerous other materials configured to provide support, such as, for example, composite, ceramic, ceramic matrix composite, plastics, polymers, alloys, austenitic nickel-chromium-based alloys, glass, binder, epoxy, polyester, acrylic, wood, biological material or any material or combination of materials having a desired strength, stiffness, density, weight, or flexibility sufficient to maintain resiliency during use. In various embodiments, various portions of wearable wafer turn clip mounting systems as disclosed herein are made of different materials or combinations of materials, and/or may comprise coatings.

In various embodiments, wearable wafer turn clip mounting systems may comprise multiple materials, or any material configuration suitable to enhance or reinforce the resiliency and/or support of the system when subjected to wear in an operating environment or to satisfy other desired weight, size, electromagnetic, chemical, physical, or biological properties, for example nonreactivity, light weight, load capacity, and heat tolerance.

Various manufacturing and construction techniques may include separate manufacture of components and attachment together by mechanical and/or chemical means, such as a grip ring (discussed herein) and body ring (discussed herein) as well as manufacture out of similar or different materials such as a rubber grip ring and alloy body ring and/or the like. Further manufacturing and construction techniques may include additive manufacturing, such as 3D printing, stereolithography, and/or the like.

In various embodiments, while the wearable wafer turn clip mounting systems described herein have been described in the context of devices mounted to clothing; however, one will appreciate in light of the present disclosure, that the systems and apparatuses described herein may be used, for example, in connection with industrial processes, connection systems, safety systems, holster systems, body mount camera systems, medical apparatuses, structural wearable wafer turn clip mounting systems for walls, or any other system or process having different elements needing to be retained and/or supported.

Benefits, other advantages, and solutions to problems have been described herein with regard to specific embodiments. Furthermore, the connecting lines shown in the various Figures contained herein are intended to represent exemplary functional relationships and/or physical couplings between the various elements. It should be noted that alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A clip comprising:

a body comprising at least a partial annulus;

an inner section comprising a flange extending into a center area of the at least partial annulus of the body;

a mount acceptance channel comprising a counterclockwise arcuate channel defined by an edge of the body and an edge of at least a portion of the inner section; and a deflection channel comprising a clockwise arcuate channel disposed at a terminus of the mount acceptance channel and with a point of inflection at the terminus and extending at least partially outward from the mount acceptance channel, wherein the clip is configured to accept an article inserted between the body and the inner section whereby the clip is configured to mechanically engage with the article within the deflection channel.

2. The clip according to claim 1, wherein the arcuate channel of the deflection channel extends at least partially radially outward from the mount acceptance channel with decreasing width.

3. The clip according to claim 1, further comprising a grip member comprising an arcuate flange disposed outward of the body along at least a portion of an outer edge of the body.

4. The clip according to claim 3, further comprising a manipulation surface comprising a surface disposed on a radially outward edge of the grip member.

5. The clip according to claim 3, wherein at least a portion of the grip member is thicker than at least a portion of the body, wherein the outer edge of the body defines a circumferential edge of a thicker portion of the grip member and a thinner portion of the body.

6. The clip according to claim 1, wherein the mount acceptance channel further extends at least partially tangentially to at least one of the grip member and the body.

7. The clip according to claim 1, further comprising a tip engagement comprising a raised dome disposed at a radially and circumferentially outermost end of the body.

8. The clip according to claim 1, wherein the arcuate channel of the mount acceptance channel has a constant radius.

9. A method of donning a clip, the method comprising:

inserting an article into a mount acceptance channel extending arcuately in a counterclockwise direction and between a body and an inner section of the clip, wherein the body comprises an at least a partial annulus and the inner section comprises a flange extending into a center area of the at least partial annulus of the body;

rotating the clip; and engaging the article in a deflection channel comprising a clockwise arcuate channel disposed at a terminus of the mount acceptance channel and with a point of inflection at the terminus and extending at least partially outward from the mount acceptance channel.

10. The method of donning the clip according to claim 9, further comprising rotatably interconnecting a device mount configured to receive a device to the clip.

11. The method of donning the clip according to claim 9, wherein the clip further comprises a grip member comprising an arcuate flange disposed outward of the body along at least a portion of an outer edge of the body.

12. The method of donning the clip according to claim 11, wherein at least a portion of the grip member is thicker than at least a portion of the body, wherein the outer edge of the body defines an edge of a thicker portion of the grip member and a thinner portion of the body.

13. The method of donning the clip according to claim 9, wherein the mount acceptance channel has a constant radius.

14. A clip comprising:

a body comprising at least a partial annulus;

an inner section extending from the body;

a mount acceptance channel comprising a counterclockwise channel defined by at least one of the body and the inner section; and a deflection channel comprising a clockwise channel extending from an inward terminus of the mount acceptance channel and adjacent the inner section and with a point of inflection at the inward terminus, wherein the deflection channel is configured to mechanically engage with an article within the deflection channel.

15. The clip according to claim 14, wherein the mount acceptance channel has a constant radius.

16. A clip comprising:

a body comprising an arcuate boss forming at least a partial annulus;

a grip member comprising an arcuate flange disposed aligned at least partially co-planar with and radially outward of the body along at least a portion of an outer edge of the body, wherein at least a portion of the grip member is thicker than at least a portion of the body, wherein the outer edge of the body defines an edge of a thicker portion of the grip member and a thinner portion of the body;

an inner section comprising a flange extending from at least one of the body and the grip member inwardly into a center area of the at least partial annulus of the body.

17. The clip according to claim 16, further comprising:

a mount acceptance channel comprising an arcuate channel defined by a radially inward edge of the body and a radially outward edge of at least a portion of the inner section; and a deflection channel comprising an arcuate channel disposed at an inward terminus of the mount acceptance channel and including a point of inflection at the inward terminus of the mount acceptance channel and extending at least partially radially outward from the mount acceptance channel;

wherein the clip is configured to accept an article inserted between the body and the inner section whereby the clip is configured to mechanically engage with the article within the deflection channel.

18. The clip according to claim 16, further comprising:

a device mount rotatable interconnecting to the clip and configured to receive a device, and wherein the clip is configured to receive a portion of the operator's body between the device mount and at least one of the grip member and the body of the clip.

19. A clip comprising:

a body comprising a flange;

an inner section comprising a further portion of the body extending from the flange; and a mount acceptance channel comprising a counterclockwise channel at least partially defined between the body and the inner section; and a deflection channel defined at least partially through at least a portion of the body and extending clockwise from the mount acceptance channel.

20. The clip according to claim 19, further comprising:

a point of inflection at a joining of the deflection channel and the mount acceptance channel, and wherein the deflection channel is configured to mechanically engage with an article within the deflection channel.

* * * * *